US008298006B2

(12) United States Patent
Wild et al.

(10) Patent No.: US 8,298,006 B2
(45) Date of Patent: Oct. 30, 2012

(54) CONNECTOR CONTACT FOR TUBULAR CENTER CONDUCTOR

(75) Inventors: Werner Karl Wild, Buttenwiesen (DE); Adam Thomas Nugent, Canastota, NY (US)

(73) Assignee: John Mezzalingua Associates, Inc., Syracuse, NY (US)

( * ) Notice: Subject to any disclaimer, the term of this patent is extended or adjusted under 35 U.S.C. 154(b) by 0 days.

(21) Appl. No.: 13/178,492

(22) Filed: Jul. 8, 2011

(65) Prior Publication Data

US 2012/0088381 A1 Apr. 12, 2012

Related U.S. Application Data

(60) Provisional application No. 61/391,391, filed on Oct. 8, 2010.

(51) Int. Cl.
*H01R 9/05* (2006.01)

(52) U.S. Cl. ..... 439/578; 439/447; 439/675

(58) Field of Classification Search ..... 439/447, 439/578, 580, 583, 584, 675
See application file for complete search history.

(56) References Cited

U.S. PATENT DOCUMENTS

| | | | | |
|---|---|---|---|---|
| 3,764,959 | A | | 10/1973 | Toma et al. |
| 3,910,673 | A | | 10/1975 | Stokes |
| 4,531,805 | A | | 7/1985 | Werth |
| 4,579,415 | A | | 4/1986 | Van Brunt et al. |
| 4,676,577 | A | | 6/1987 | Szegda |
| 4,808,128 | A | | 2/1989 | Werth |
| 4,952,174 | A | | 8/1990 | Sucht et al. |
| 5,137,470 | A | | 8/1992 | Doles |
| 5,167,533 | A | | 12/1992 | Rauwolf |
| 5,199,894 | A | | 4/1993 | Kalny et al. |
| 5,322,454 | A | | 6/1994 | Thommen |
| 5,393,244 | A | | 2/1995 | Szegda |
| 5,397,243 | A | * | 3/1995 | MacMurdo, Sr. ..... 439/136 |
| 5,435,745 | A | | 7/1995 | Booth |
| 5,518,420 | A | | 5/1996 | Pitschi |
| 5,620,339 | A | | 4/1997 | Gray et al. |
| 5,720,630 | A | | 2/1998 | Richmond et al. |
| 5,766,037 | A | | 6/1998 | Nelson |

(Continued)

FOREIGN PATENT DOCUMENTS

DE 4344328 C1 1/1995

(Continued)

OTHER PUBLICATIONS

PCT/US2011/055423. International Search Report and Written Opinion. Date of Mailing: Mar. 26, 2012. 11 pages.

(Continued)

*Primary Examiner* — James Harvey
(74) *Attorney, Agent, or Firm* — Schmeiser, Olsen & Watts, LLP

(57) ABSTRACT

A contact assembly comprising: a contact pin having a first end and a second end, the contact pin including a ramped portion, and a contact sleeve retainably attached to the first end of the contact pin, the contact sleeve having a flanged end and a non-flanged end, wherein the contact sleeve includes a one or more fingers, wherein, when in a first position, clearance exists between the contact sleeve and the contact pin, wherein, when in a second position, the one or more fingers of the contact sleeve engage an inner surface of a tubular center conductor to increase a moving force required to displace the contact assembly within the tubular center conductor is provided. An associated method is also provided.

36 Claims, 18 Drawing Sheets

U.S. PATENT DOCUMENTS 5,863,220 A 1/1999 Holliday
5,938,474 A 8/1999 Nelson
6,019,519 A 2/2000 Grinderslev et al.
6,019,636 A 2/2000 Langham
6,032,358 A 3/2000 Wild
6,102,738 A 8/2000 Macek et al.
6,109,964 A 8/2000 Kooiman
6,123,567 A * 9/2000 McCarthy ..... 439/427
6,133,532 A 10/2000 Lundback et al.
6,183,298 B1 2/2001 Henningsen et al.
6,203,360 B1 * 3/2001 Harting et al. ..... 439/412
6,206,579 B1 3/2001 Selfridge et al.
6,264,374 B1 7/2001 Selfridge et al.
6,267,621 B1 7/2001 Pitschi et al.
6,272,738 B1 8/2001 Holliday et al.
6,309,251 B1 10/2001 Tang
6,331,123 B1 12/2001 Rodrigues
6,386,915 B1 5/2002 Nelson
6,471,545 B1 10/2002 Hosler, Sr.
6,478,618 B2 11/2002 Wong
6,494,743 B1 12/2002 Lamatsch et al.
6,607,398 B2 8/2003 Henningsen
6,733,336 B1 5/2004 Montena et al.
6,840,803 B2 1/2005 Wlos et al.
6,884,113 B1 4/2005 Montena
6,939,169 B2 9/2005 Islam et al.
6,955,562 B1 10/2005 Henningsen
6,976,872 B1 12/2005 Wild et al.
7,008,264 B2 3/2006 Wild
7,021,965 B1 4/2006 Montena
7,029,304 B2 4/2006 Montena
7,029,326 B2 4/2006 Montena
7,070,447 B1 7/2006 Montena
7,077,699 B2 7/2006 Islam et al.
7,086,897 B2 8/2006 Montena
7,104,839 B2 9/2006 Henningsen et al.
7,108,547 B2 9/2006 Kisling et al.
7,112,093 B1 9/2006 Holland
7,128,603 B2 10/2006 Burris et al.
7,131,868 B2 11/2006 Montena
7,156,560 B2 1/2007 Seeley
7,156,696 B1 1/2007 Montena
7,163,420 B2 1/2007 Montena
7,189,115 B1 3/2007 Montena
7,207,838 B2 4/2007 Andreescu
7,264,502 B2 9/2007 Holland
7,278,854 B1 10/2007 Robinette et al.
7,303,435 B2 12/2007 Burris et al.
7,309,255 B2 12/2007 Rodrigues
7,335,059 B2 2/2008 Vaccaro
7,347,729 B2 3/2008 Thomas et al.
7,351,101 B1 4/2008 Montena
7,357,672 B2 4/2008 Montena
7,458,851 B2 12/2008 Montena
7,497,729 B1 3/2009 Wei
7,566,243 B1 7/2009 Hung
7,588,460 B2 9/2009 Malloy et al.
7,632,143 B1 12/2009 Islam
7,637,774 B1 12/2009 Vaccaro
7,806,724 B2 10/2010 Paynter et al.
7,824,215 B2 11/2010 Islam et al.
7,857,661 B1 12/2010 Islam
7,918,687 B2 4/2011 Paynter et al.
7,927,134 B2 4/2011 Paynter et al.
7,993,159 B2 8/2011 Chawgo
8,007,314 B2 8/2011 Chawgo et al.
8,038,472 B2 10/2011 Montena et al.
8,047,870 B2 11/2011 Clausen
8,123,557 B2 2/2012 Montena et al.
8,177,583 B2 5/2012 Chawgo et al.
2005/0079761 A1 4/2005 Rodrigues
2006/0014427 A1 1/2006 Islam et al.
2006/0134979 A1 6/2006 Henningsen
2006/0199431 A1 9/2006 Paynter
2006/0246774 A1 11/2006 Buck
2007/0149047 A1 6/2007 Wild et al.
2007/0270032 A1 11/2007 Eriksen
2008/0003873 A1 1/2008 Henningsen
2008/0274643 A1 11/2008 Chawgo
2009/0197465 A1 8/2009 Montena et al.
2009/0233482 A1 9/2009 Chawgo et al.
2009/0269979 A1 10/2009 Montena
2010/0261381 A1 10/2010 Montena et al.
2010/0261382 A1 10/2010 Montena et al.
2010/0273340 A1 10/2010 Clausen
2011/0008998 A1 1/2011 Low et al.
2011/0009000 A1 1/2011 Paynter
2011/0021074 A1 1/2011 Paynter et al.
2011/0263154 A1 10/2011 Chawgo et al.
2012/0088381 A1 * 4/2012 Wild et al. ..... 439/131
2012/0088404 A1 4/2012 Wild et al.
2012/0088405 A1 4/2012 Wild et al.
2012/0102733 A1 5/2012 Wild

FOREIGN PATENT DOCUMENTS

EP 1858123 A2 11/2007
EP 2190068 A1 5/2010
EP 2219267 B1 1/2011

OTHER PUBLICATIONS

Notice of Allowance (Mail Date Apr. 1, 2011) for U.S. Appl. No. 11/743,633, filed May 2, 2007; Confirmation No. 7249.
Notice of Allowance (Mail Date Apr. 25, 2011) for U.S. Appl. No. 12/469,313, filed May 20, 2009; Confirmation No. 1663.
Notice of Allowance (Mail Date Jun. 13, 2011) for U.S. Appl. No. 12/421,894, filed Apr. 10, 2009; Confirmation No. 5395.
Office Action (Mail Date Mar. 23, 2011) for U.S. Appl. No. 12/421,855, filed Apr. 20, 2009; Confirmation No. 5331.
Application No. PCT/US2010/029725, International Search Report and the Written Opinion of the International Searching Authority, or the Declaration dated Nov. 16, 2010. 8 pages.
U.S. Appl. No. 13/178,483, filed Jul. 7, 2011; Confirmation No. 8511.
U.S. Appl. No. 13/178,397, filed Jul. 7, 2011; Confirmation No. 8327.
U.S. Appl. No. 13/178,443, filed Jul. 7, 2011; Confirmation No. 8409.
U.S. Appl. No. 12/421,826, filed Apr. 10, 2009; Confirmation No. 5251.
U.S. Appl. No. 13/174,697, filed Jun. 30, 2011; Confirmation No. 1265.
U.S. Appl. No. 61/505,535, filed Jul. 8, 2011; Confirmation No. 8532.
U.S. Appl. No. 13/077,582, filed Mar. 31, 2011; Confirmation No. 5822.
U.S. Appl. No. 13/178,490, filed Jul. 8, 2011; Confirmation No. 8531.
U.S. Appl. No. 13/228,441, filed Sep. 8, 2011; Confirmation No. 7498.
U.S. Appl. No. 13/228,445, filed Sep. 8, 2011; Confirmation No. 7510.
U.S. Appl. No. 13/178,408, filed Jul. 7, 2011; Confirmation No. 8362.
U.S. Appl. No. 13/178,488, filed Jul. 7, 2011; Confirmation No. 8527.

* cited by examiner

CONNECTOR CONTACT FOR TUBULAR CENTER CONDUCTOR

CROSS-REFERENCE TO RELATED APPLICATIONS

This application is a non-provisional application claiming the benefit and priority of U.S. provisional Application No. 61/391,391, filed Oct. 8, 2010, entitled, "Connector Contact For Tubular Center Conductor."

FIELD OF TECHNOLOGY

The following relates generally to the field of coaxial cable connectors and more particularly to a contact assembly within a connector for use with coaxial cables having a tubular center conductor.

BACKGROUND

Some coaxial cables, typically referred to as hard line coaxial cables, include a center conductor constructed of a smooth-walled or corrugated, metallic (e.g., copper, aluminum, steel, copper clad aluminum, etc.) tube, the material selection depending on weight, cost, flexibility, etc. Such a center conductor is referred to herein as a tubular center conductor.

A tubular center conductor typically includes a hollow internal portion. Electrical connections to the tubular center conductor can be made within the hollow internal portion, because the electromagnetic signals within the coaxial cable pass using mainly the outer diametral portions of the tubular center conductor. Accordingly, coaxial cable connectors that are designed to work with such hard line coaxial cables typically include contacts that are extended within the hollow internal portion of the tubular center conductor. Such coaxial cable connectors are referred to herein as hard line connectors.

The contacts used in many of these hard line connectors are held against the hollow internal portion by a support arm. Each of these contacts is located at or near an end of the support arm toward the end of the contact pin or contact assembly. The support arm is cantilevered from a mounting position within the hard line connector. During installation, each of these support arms, along with its respective contact, is deflected to a smaller effective diameter during installation into the hollow internal portion. The amount of deflection may vary greatly.

Each support arm is designed with a limit of elastic deflection that allows an amount of elastic deflection before the support arm is plastically deformed. The limit of elastic deflection accounts for a range of possible variations occurring within a single tubular center conductor or between different tubular center conductors. These variations are typically small, and may include manufacturing tolerances and design variations. When a tubular center conductor is corrugated, though, the variations within a single tubular center conductor or between different tubular center conductors can be significantly large. The limit of elastic deflection is less able to allow for significantly large variations. It has been observed that many of these significantly large variations cause the support arms to deflect beyond their limits of elastic deflection and become plastically deformed during installation. Once the support arm is plastically deformed, it will not return to its original position after a deflection.

Any plastic deformation of the support arms may result in a poor electrical connection between the contacts and the hollow internal portion of the tubular center conductor. As described above, each contact may be held against the hollow internal portion by a respective support arm. An amount of pressure applied by each contact is determined by the amount of elastic deflection between a free-state position of each support arm and an installed-state position of the support arm. Accordingly, any amount of plastic deformation of the support arm during installation will result in a reduced free-state position and, therefore, a reduced pressure applied by each contact.

Previous attempts have been made to increase the amount of elastic deflection available to each support arm by reducing the cross sectional thickness of the support arm. This reduction in the cross sectional thickness naturally allows for greater elastic deflections before the support arm becomes plastically deformed. It is important to note, however, that this reduction in the cross sectional thickness correspondingly reduces the amount of pressure applied to the contact. Any reduction in, or elimination of the amount of pressure applied to the contact may reduce the quality of the connection and degrade the signal.

Other attempts have been made to increase the amount of pressure applied to the contact by various methods, such as increasing the cross sectional thickness of each support arm and using more resilient materials. This increase in the amount of pressure comes with a strong disadvantage of increasing an amount of moving force required to install the contact assembly into the hollow internal portion of the tubular center conductor. This increased installation force may result in damaged contacts and/or an incomplete installation. Both of these outcomes may reduce the quality of the connection and degrade the signal.

Another solution uses a plastic or ceramic insert that inserts into the contact and pushes the support arms of the contact outward against the internal surface of the hollow center conductor. This method uses an additional component—the insert, which is made of a nonconductive plastic or ceramic.

In all of these methods described above, the quality of the electrical connection between the contact and the hollow internal portion of the tubular center conductor can negatively affect the resulting electrical signal and the performance of any connector of which the contact is a component. With the contact being on the end of the support arm and the end of the contact pin or contact assembly that inserts deepest into the tubular center conductor, the contact contacts the tubular center conductor a distance away from the end of the tubular center conductor. Electromagnetic signals can travel to the end of the tubular center conductor, and then bounce or double back causing interference and degrading the electrical signal that passes between the tubular center conductor and the contact.

Furthermore, with a helical or corrugated tubular center conductor, the points of contact between the contact and the center conductor around the circumference of the contact can vary axially from a plane perpendicular to the axis of the contact. While the helical corrugations provide structural stability during bending of the coaxial cable and the tubular center conductor, the helical corrugations also provide a non-regular surface against which the contacts make contact. One or more contacts around the radius of the tubular center conductor are likely to contact the tubular center conductor at different axial locations along the length of the contact. For instance, one contact might contact the tubular center conductor at a first end of the respective contact, while another contact, or portion of the same contact, might contact the tubular center conductor at a second end of the respective contact opposite the first end in the axial direction. The contact that contacts the tubular center conductor at the second end of the contact can produce an undesirable RF effect on the performance of the connector. A "hanging" reverse path for RF propagation is created, which acts like a resonating stub. This effect can reduce the overall transmission efficiency of the connector, and result in the appearance of a periodic phantom high and low impedance downstream of the contact when viewing the connector and the coaxial cable in a time domain.

It would be advantageous to electrically connect a coaxial cable connector to a tubular center conductor of a hard line coaxial cable without the limitations of the methods and/or apparatus discussed above.

SUMMARY

A first general aspect relates to a contact assembly comprising: a contact pin having a first end and a second end, the contact pin including a ramped portion, and a contact sleeve retainably attached to the first end of the contact pin, the contact sleeve having a flanged end and a non-flanged end, wherein the contact sleeve includes a plurality of fingers, wherein, when in a first position, clearance exists between the contact sleeve and the contact pin, wherein, when in a second position, the fingers of the contact sleeve engage an inner surface of a tubular center conductor.

A second general aspect relates to a connector positioned to be connected to a coaxial cable, the coaxial cable including a tubular center conductor, an outer insulating layer, an outer conductor, and a dielectric layer, the connector comprising a body having a forward end and a rearward end, a cap concentrically disposed over the rearward end of the body, and a contact assembly, wherein the contact assembly includes: a contact pin having a first end and a second end, the contact pin including a ramped portion, and a contact sleeve retainably attached to the first end of the contact pin, the contact sleeve having a flanged end and a non-flanged end, wherein the contact sleeve includes a plurality of fingers, wherein the compression cap axially compresses the connector into a position of intereference from a position clearance, the interference being between the plurality of fingers and an inner surface of the tubular center conductor.

A third general aspect relates to a method of ensuring electrical contact with a tubular center conductor, comprising: providing a contact assembly, wherein the contact assembly includes: a contact pin having a first end and a second end, the contact pin including a ramped portion, and a contact sleeve retainably attached to the first end of the contact pin, the contact sleeve having a flanged end and a non-flanged end, wherein the contact sleeve includes a plurality of fingers, and driving the contact sleeve towards the second end of the contact pin to position the contact sleeve into engagement with the ramped portion of the contact pin to radially expand the fingers of the contact sleeve into contact with an inner surface of the tubular center conductor.

A fourth general aspect relates to a coaxial cable connector comprising a body having a forward end and a rearward end, a cap concentrically disposed over the rearward end of the body, and a contact assembly, wherein the contact assembly includes: a contact pin having a ramped portion, and a contact sleeve retainably attached to the first end of the contact pin; and a cover disposed over at least a portion of the connector to seal the connector against environmental elements.

The foregoing and other features of construction and operation will be more readily understood and fully appreciated from the following detailed disclosure, taken in conjunction with accompanying drawings.

BRIEF DESCRIPTION OF THE DRAWINGS

For a further understanding of the nature and objects of the invention, references should be made to the following detailed description of a preferred mode of practicing the invention, read in connection with the accompanying drawings in which.

DETAILED DESCRIPTION

Figure 1:
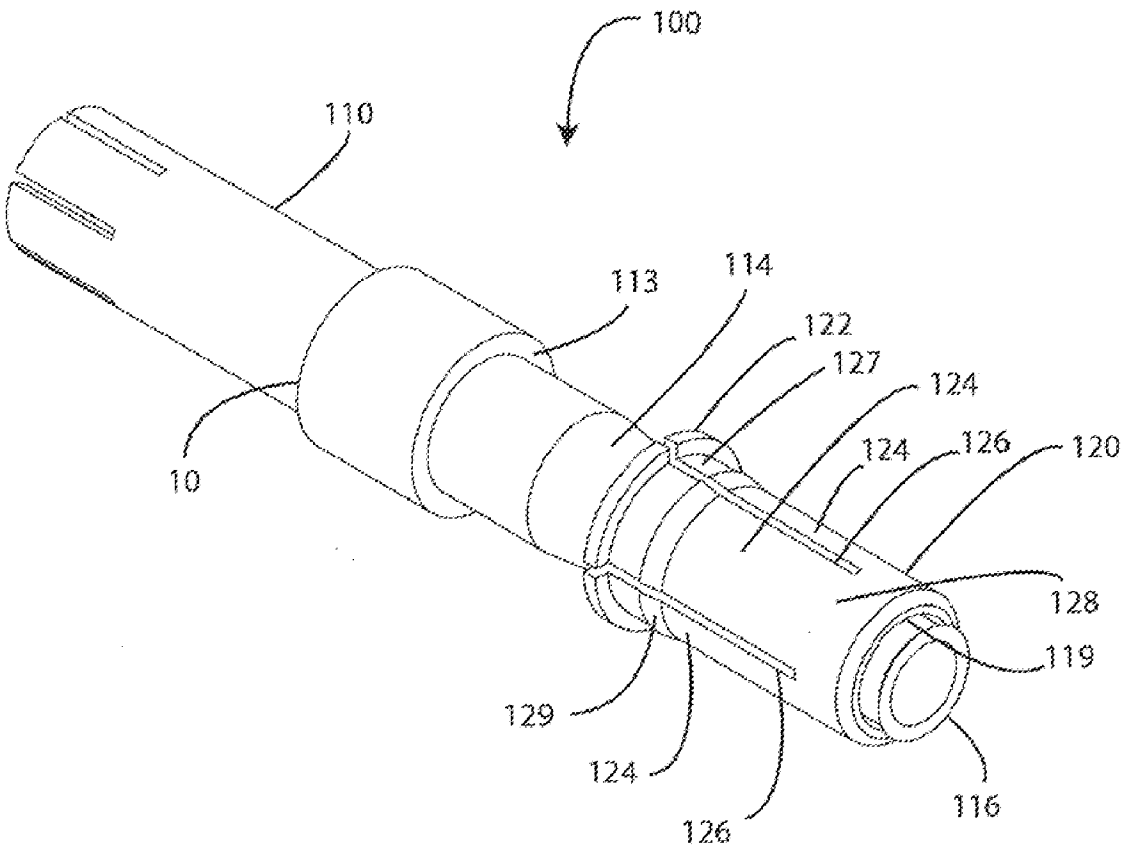
FIG. 1 shows a perspective view of a first embodiment of a contact assembly in a first position of clearance, having a sleeve retained by a retaining flange.

FIG. 1 shows a perspective view of a contact assembly 100 in a first position of clearance, wherein the contact pin includes a first end 101 and a second end 102. Embodiments of a contact pin 100 may include a contact sleeve 120 retained on, or retainably attached to, a contact pin 110. In one embodiment, the contact sleeve 120 may be retainably attached to the contact pin 110 by a retaining flange 116. In another embodiment, the contact sleeve 120 may be retainably attached to the contact pin 110 through compliance between the sleeve 120 and the contact 110, such as a slotted sleeve 120 or a slotted contact pin 110 to provide resiliency to the respective component. The contact pin 110 has a first ridge 112, a second ridge 113, and a ramped portion 114. The retaining flange 116 can be added to the contact pin 110 after the contact sleeve 120 is assembled onto the contact pin 110. The ramped portion 114 tapers toward the end of the contact pin 110 that can have the retaining flange 116, which is also toward the contact sleeve 120 in the first position of clearance. The end of the contact pin 110 that can have the retaining flange 116 can also define a hollow portion, which can be created by boring or other known methods. The retaining flange 116 can be created, for example, by crimping the end of the contact pin 110.

Figure 2:
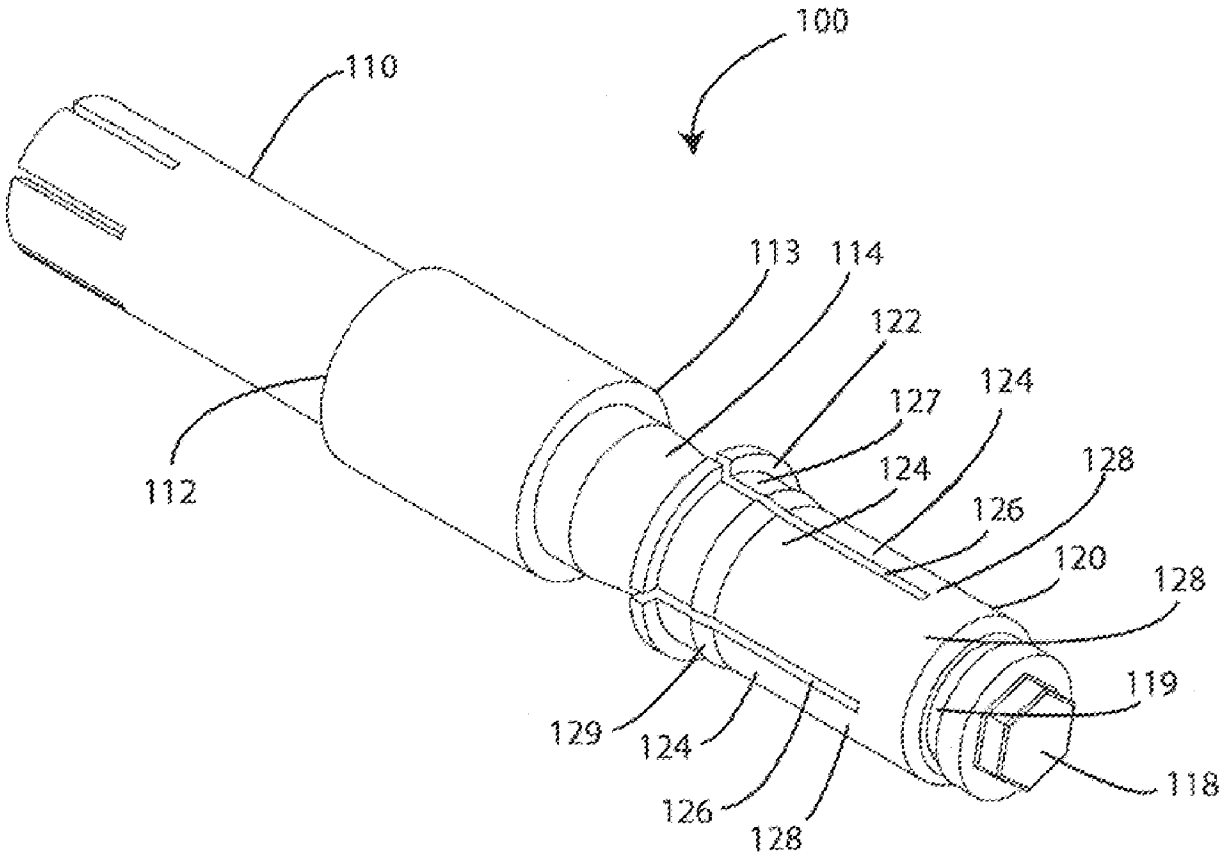
FIG. 2 shows a perspective view of a second embodiment of a contact assembly in a first position of clearance, having a sleeve retained by a retaining screw.
Figure 3:
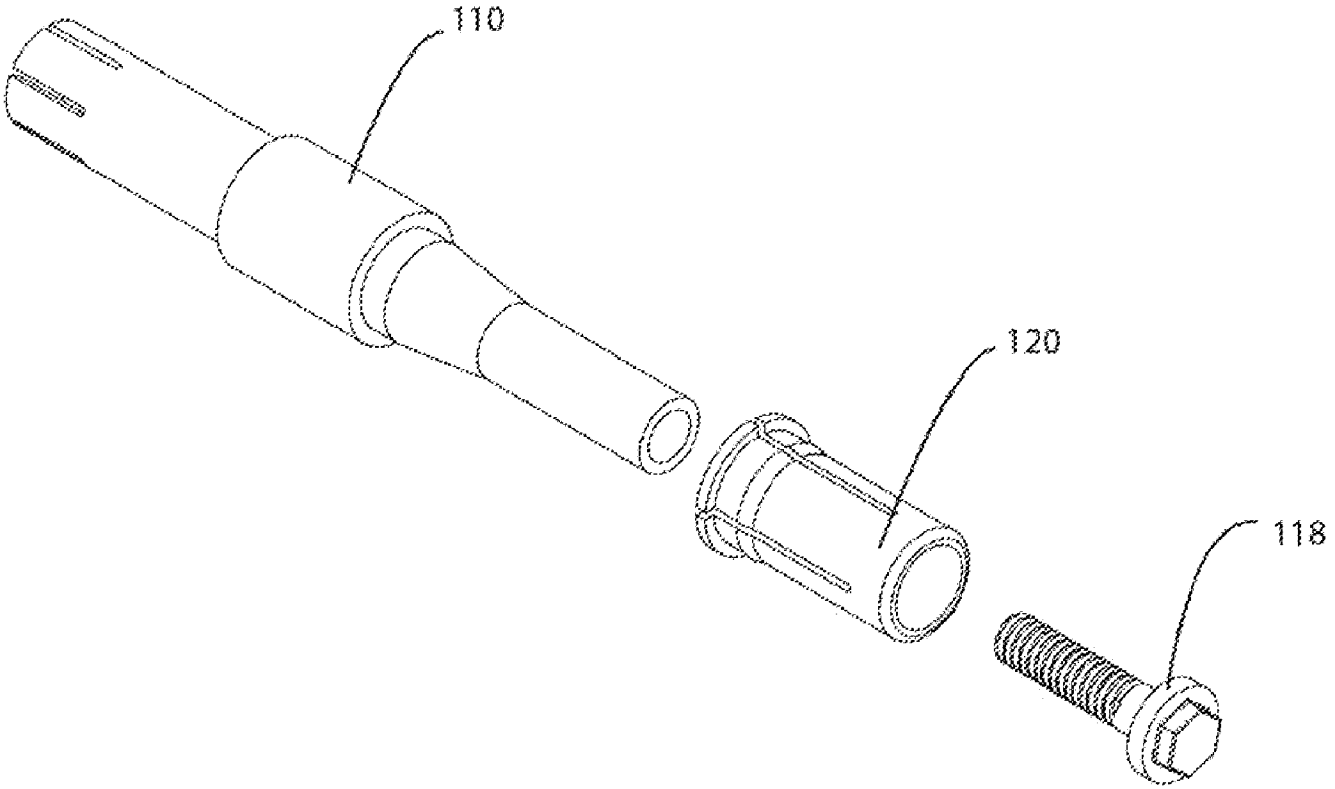
FIG. 3 shows an exploded view of the contact assembly of FIG. 2.

In another embodiment, as depicted in FIG. 2 and FIG. 3, the retaining flange 116 can be retained by a retaining screw 118. When a retaining screw 118 is used, the hollow portion of the contact pin 110 can extend deeper and can have internal threads. Referring to FIG. 1, FIG. 2, and FIG. 3, the retaining flange 116 or retaining screw 118 can retain the contact sleeve 120 on the contact pin 110.

Figure 4A:
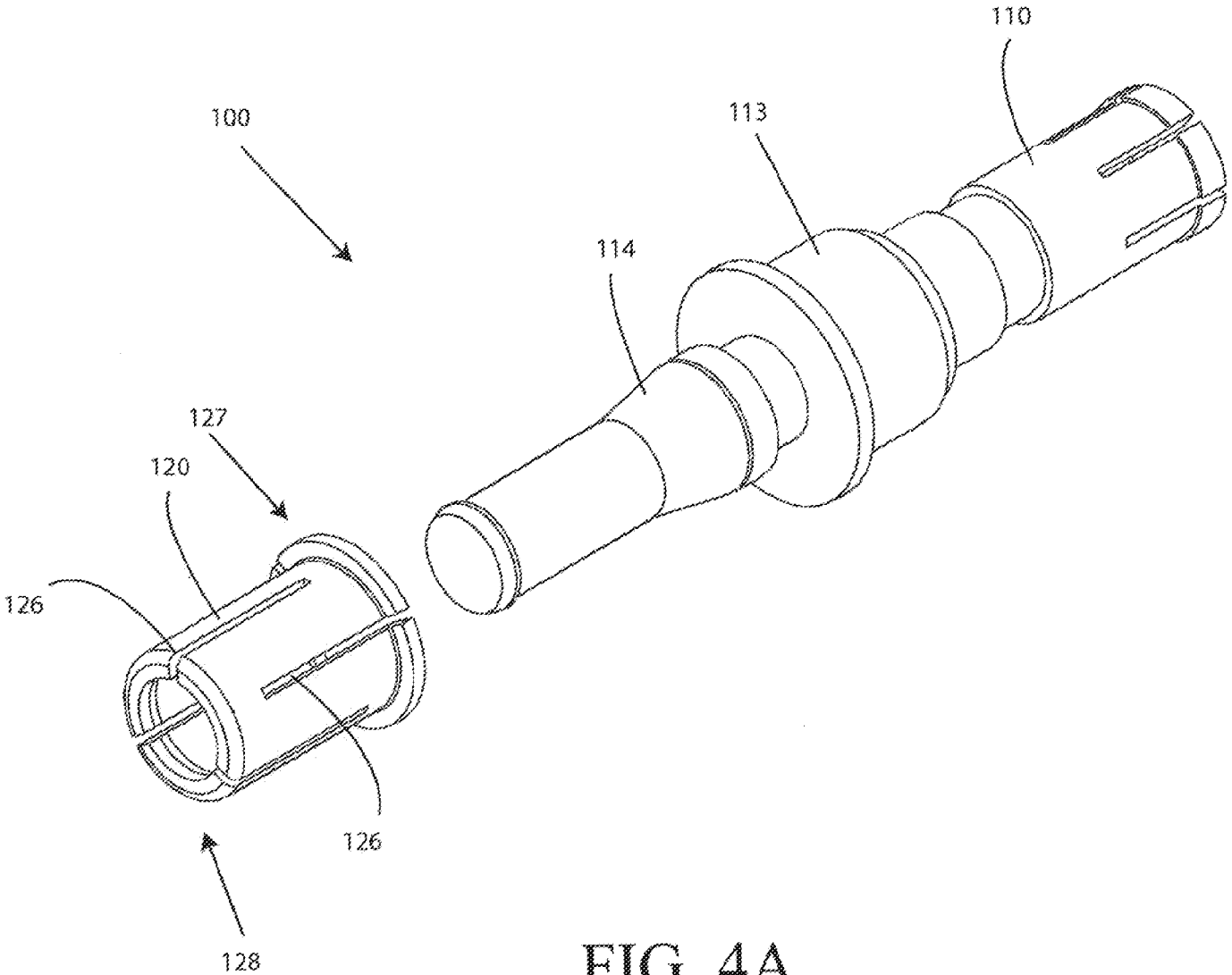
FIG. 4A depicts a perspective view of a third embodiment of the contact assembly, having a slotted contact sleeve.
Figure 4B:
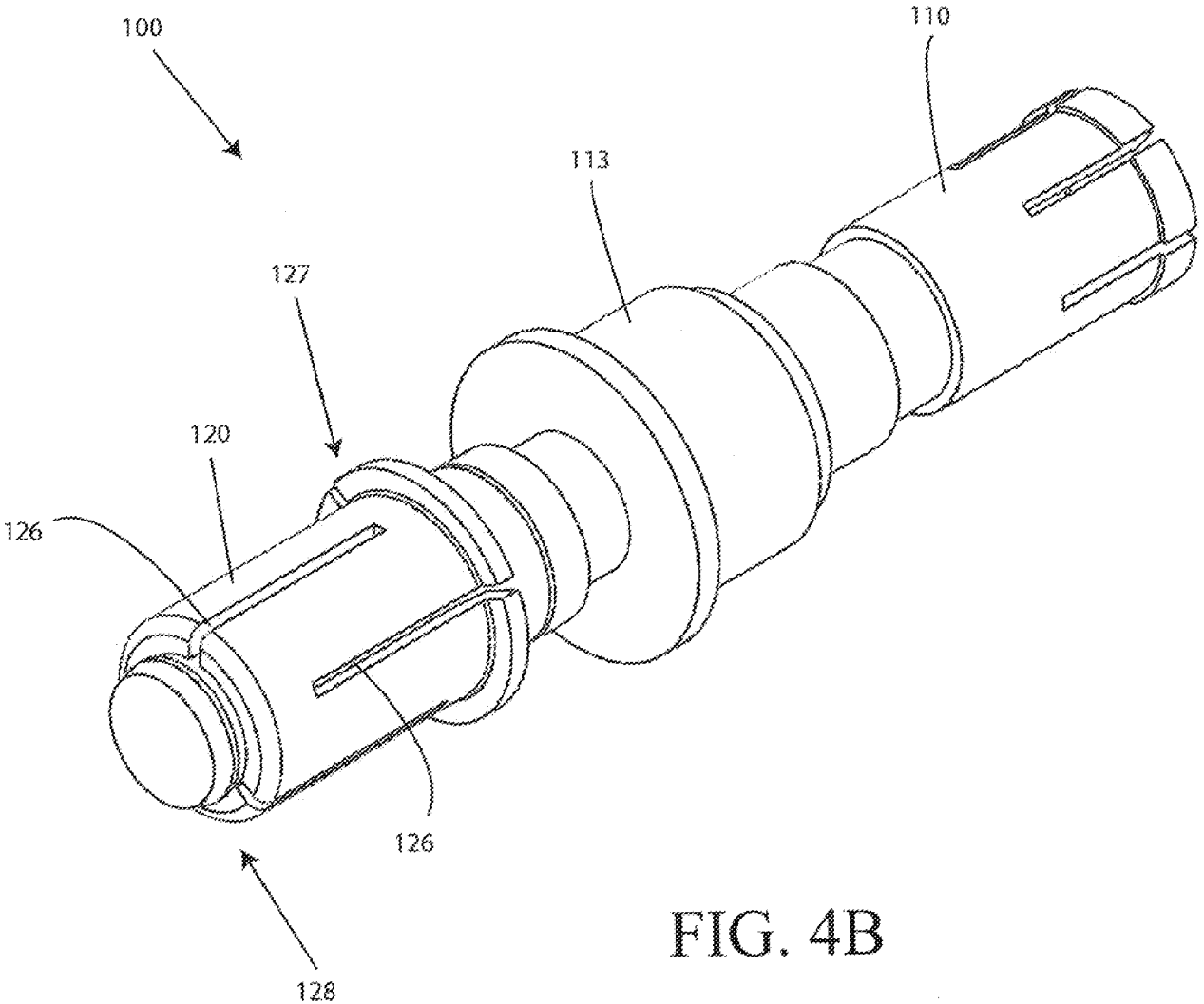
FIG. 4B depicts a perspective view of the third embodiment of the contact assembly, having a slotted contact sleeve, in a position of interference.
Figure 4C:
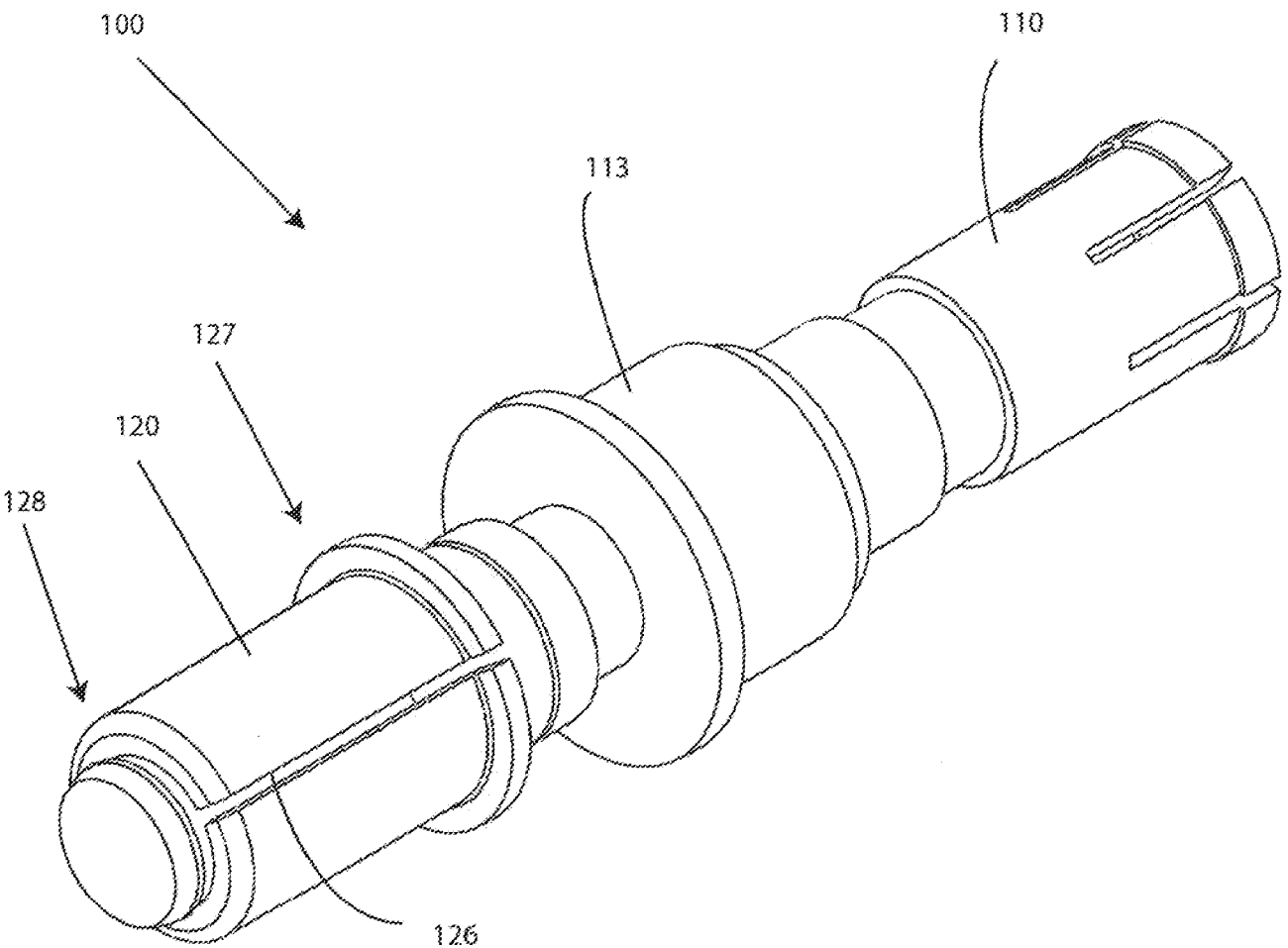
FIG. 4C depicts a perspective view of a fourth embodiment of the contact assembly, having a contact sleeve with a single axial slot, in a position of interference.
Figure 4D:
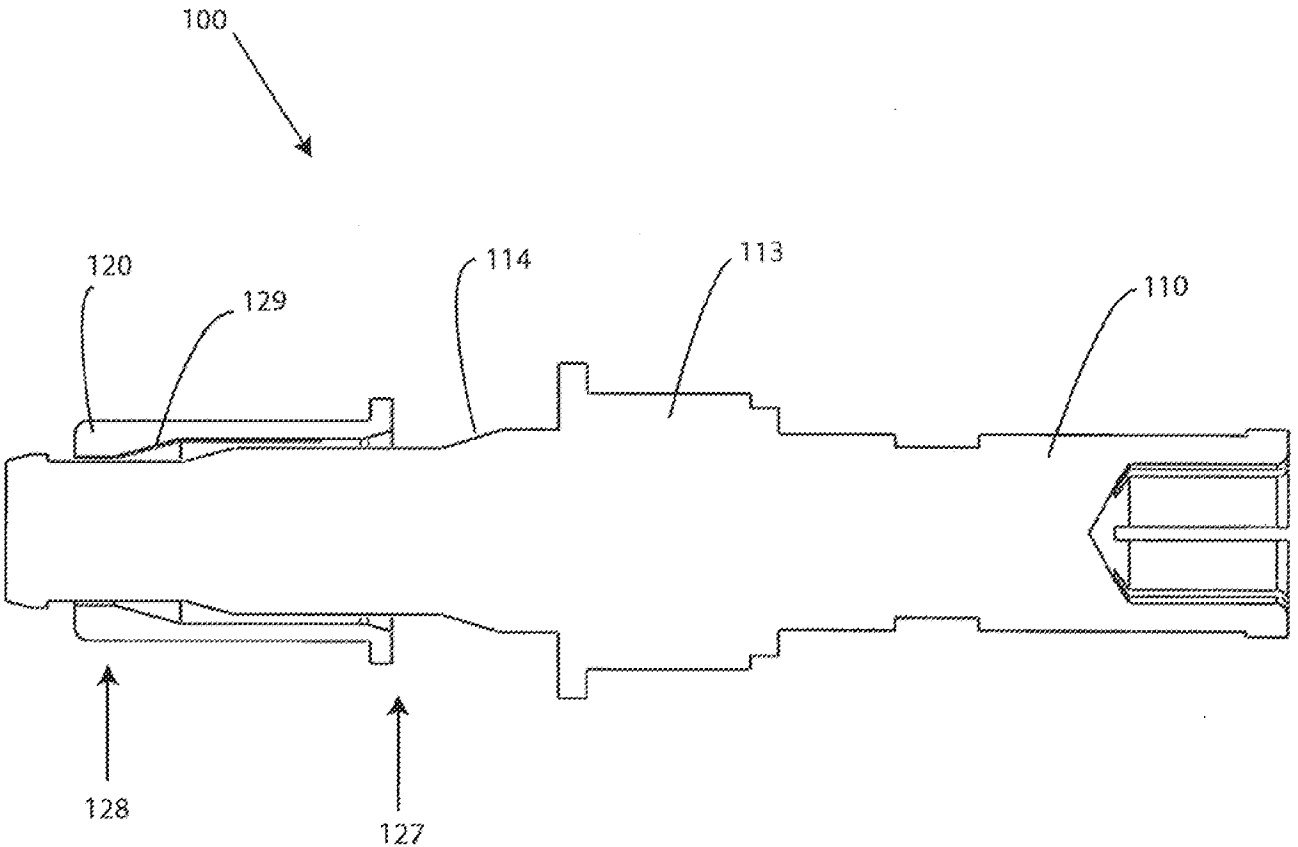
FIG. 4D depicts a cross-sectional view of a fifth embodiment of a contact assembly, having an embodiment of a slotted contact sleeve with at least one internal ramped portion, in a first position of clearance.
Figure 4E:
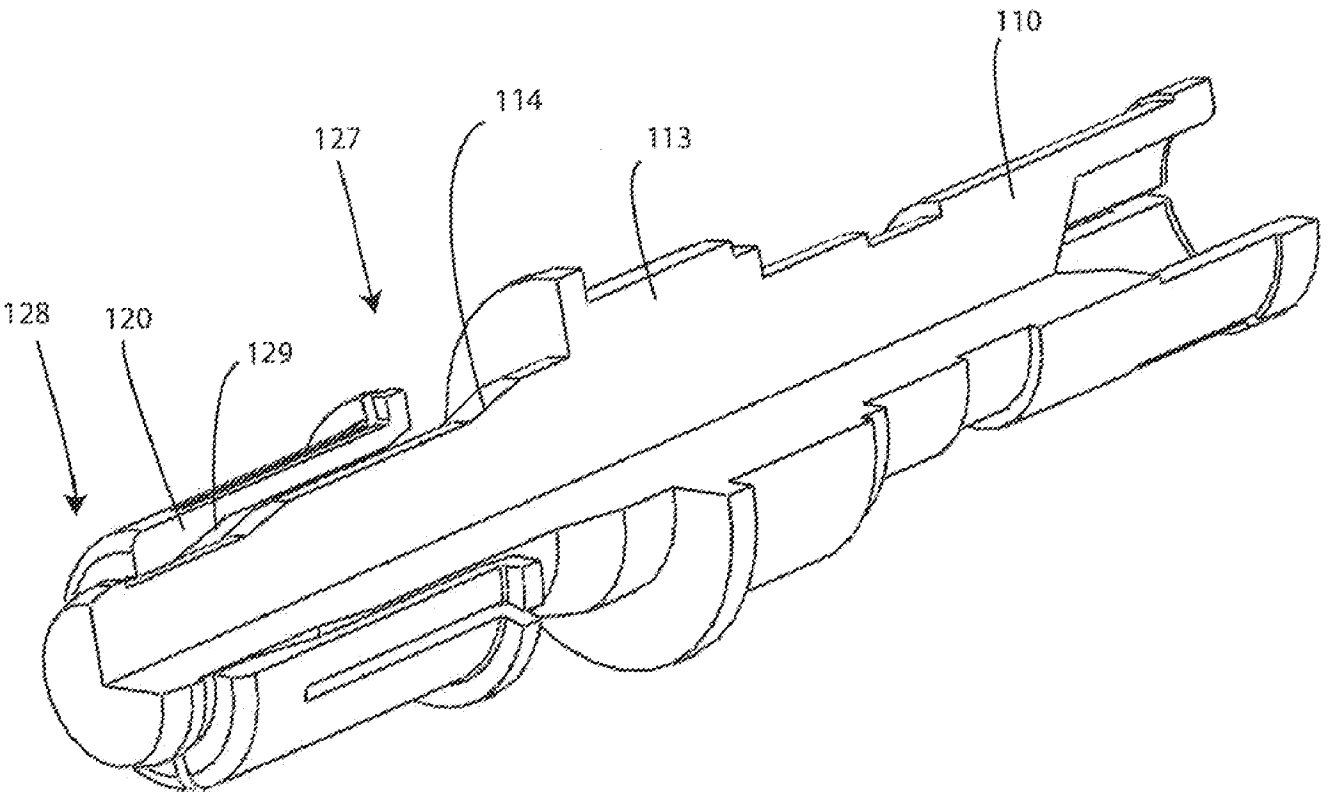
FIG. 4E depicts a perspective, partial cut-away view of the fifth embodiment of a contact assembly, having an embodiment of a slotted contact sleeve with at least one internal ramped portion, in a first position of clearance.

The contact sleeve 120 includes a contact flange 122 and fingers 124. The fingers 124 define one or more slots 126 that extend a distance through and beyond the contact flange 122 into the contact sleeve 120, separating the fingers 124. The contact flange 122 is at the flanged end 127 of the fingers 124. At the opposite end of the fingers 124 from the flanged end 127 is a non-flanged end 128. The contact sleeve 120 can also have barbs 129 that extend annularly around the contact sleeve 120 on each finger 124. The barbs 129 can be positioned toward the flanged end 127 of the fingers 124, and the slots 126 can extend between the barbs 129. The slots 126 and the fingers 124 can vary in number. FIGS. 4A-4B depict an embodiment of the contact sleeve 120 having axial slots 126 originating from the flanged end 127 and axially extending towards (but not through) the non-flanged end 128, and axial slots 126 originating from the non-flanged 128 and axially extending towards (but not through) the flanged end 127. The slots originating proximate the non-flanged end 128 permit deflection of the non-flanged end 128 of the contact sleeve 120 to snap onto the contact pin 110 and retain its position on the contact pin 110. For instance, the contact sleeve 120 (as shown in FIGS. 4A-4B) may be retainably attached to the contact pin 110 due to the biasing forces of the contact sleeve 120 proximate the non-slanged end 128 against the contact pin 110, without the need to flare the first end of the contact pin 110. FIG. 4C depicts an embodiment of the contact sleeve 120 having a single axial slot 126 axially extending lengthwise through the entire contact sleeve 120 (i.e. from the flanged end 127 through the non-flanged end 127) FIGS. 4D and 4E depict an embodiment of the contact sleeve having internal ramped portions 129 to expand the slotted sleeve 120 to engage the inner diameter of the tubular center conductor 210. Accordingly, the orientation and number of the slots 126 vary, which may ultimately change the contact pressure of the fingers 124 onto the outer surface of the contact pin 110. The contact pin 110 and the contact sleeve 120 can each be made of conductive material, such as but not limited to brass.

In alternative embodiments, the contact pin 110 may be slotted, or include one or more axial slots, to allow the contact sleeve 120 to snap over the contact pin 110, and void flaring out the end or securely fastening the sleeve 120 to the contact pin 110 to retainably attach the sleeve 120 to the contact pin 110.

In the first position of clearance, as illustrated in FIG. 1 and FIG. 2, the contact sleeve 120 is held relatively loosely on the contact pin 110. Clearance can exist between the contact sleeve 120 and the contact pin 110 along the span of the fingers 124 from the non-flanged end 128 of the contact sleeve 120 up to the flanged end 127 of the contact sleeve 120 where contact between the flanged end 127 and the ramped portion 114 of the contact pin 110 can occur. There can be a sleeve retainer 119 to hold the contact sleeve 120 in the first position of clearance until it is desired to move the contact sleeve 120 into the second position of interference. The retaining force of the sleeve retainer 119 can be overcome with a force small relative to the force required to move the contact sleeve 120 into the second position of interference. The sleeve retainer 119 can be a raised portion of the contact pin 110 that creates an interference fit between the contact pin 110 and the contact sleeve 120, and the raised portion can be near the retaining flange 116 or retaining screw 118 so that the contact sleeve 120 need only be pushed with resistance from the sleeve retainer 119 over a short distance relative to the distance required to push the contact sleeve 120 into the second position of interference, or relative to the length of the contact sleeve 120. The sleeve retainer 119 can be embodied in numerous other alternatives, as would be known to one skilled in the art. Some examples include a mild adhesive and complementary protrusion and recess. The contact pin 110 would have the protrusion and the contact sleeve 120 would have the recess.

Figure 5:
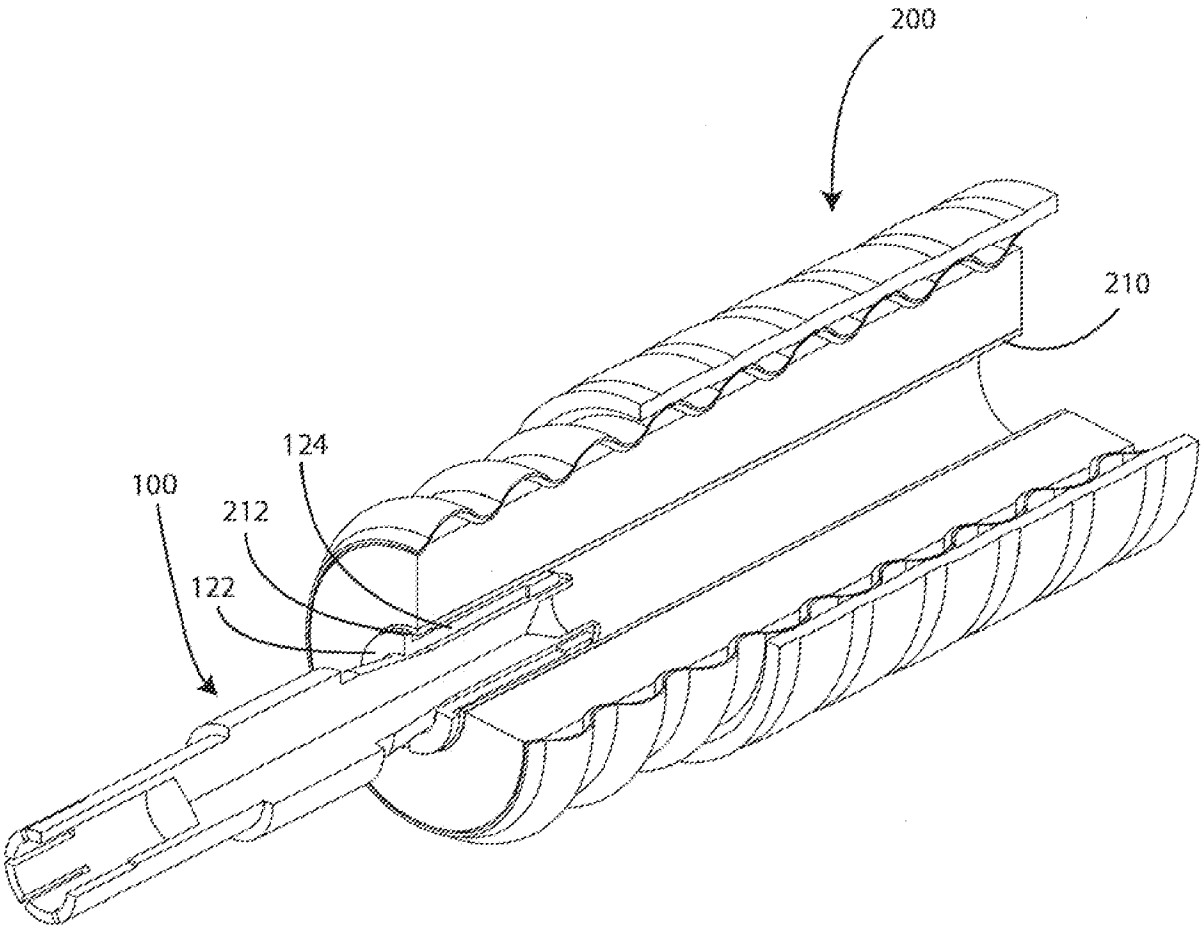
FIG. 5 shows a sectioned perspective view of a contact assembly in a first position of interference inserted into a smooth-walled tubular center conductor, according to an embodiment of the invention having a sleeve retained by a retaining flange.
Figure 6:
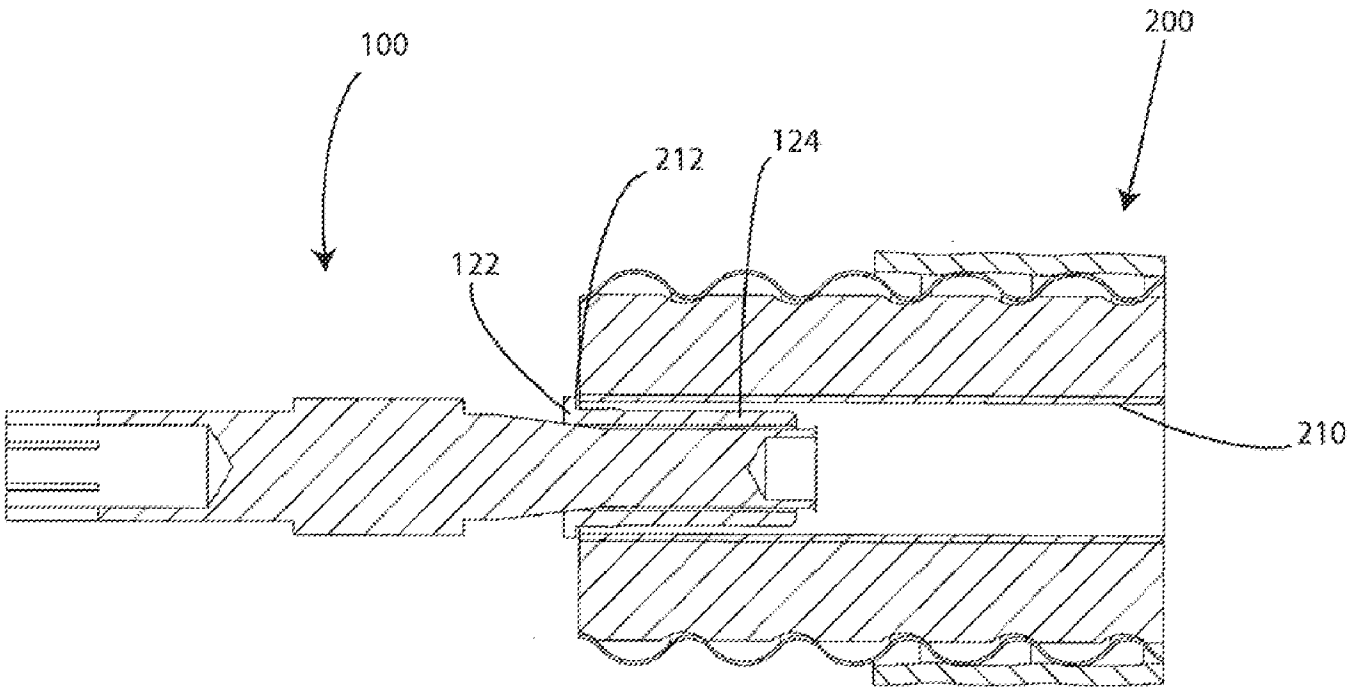
FIG. 6 shows a cross section of a contact assembly in a first position of interference inserted into a smooth-walled tubular center conductor, according to an embodiment of the invention having a sleeve retained by a retaining flange.
Figure 7:
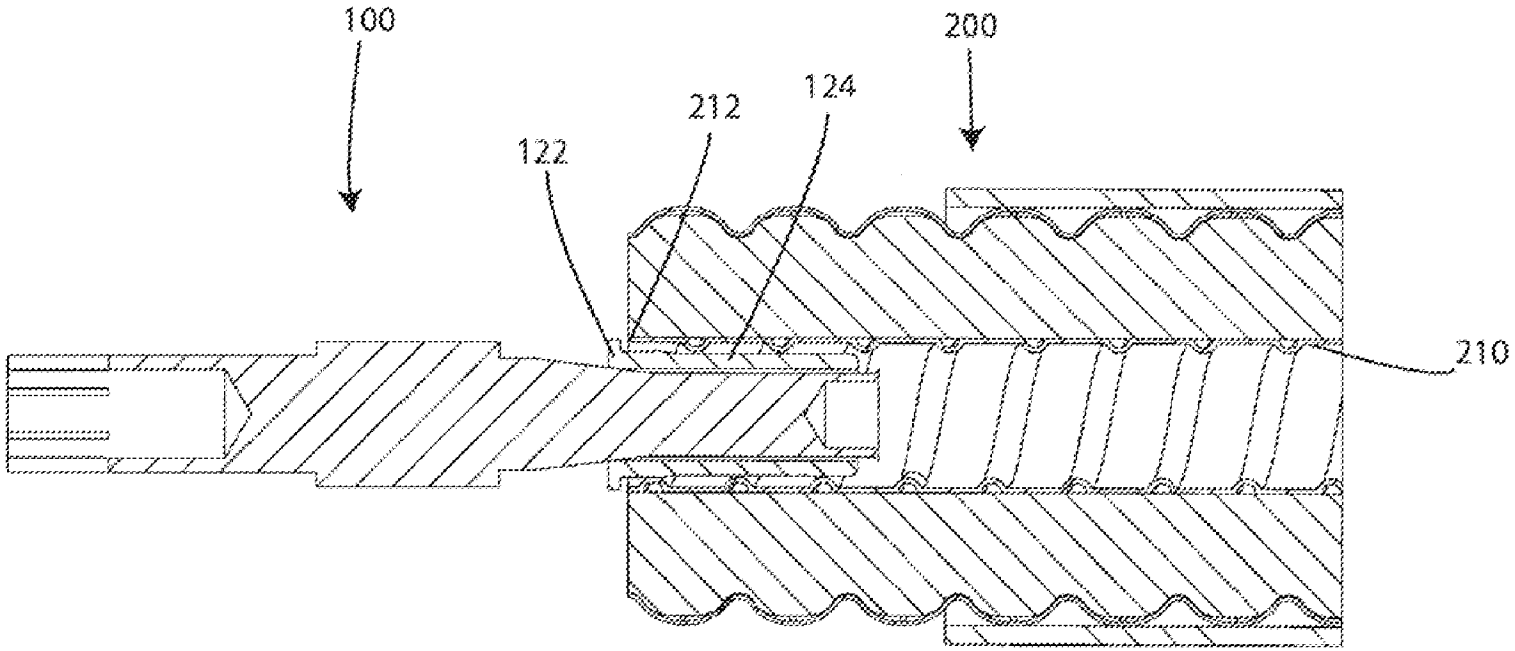
FIG. 7 shows a cross section of a contact assembly in a first position of interference inserted into a corrugated tubular center conductor, according to an embodiment of the invention having a sleeve retained by a retaining flange.

FIG. 5, FIG. 6, and FIG. 7 each show a contact assembly 100 in the first position of clearance inserted into a tubular center conductor 210. In FIG. 5 and FIG. 6, the tubular center conductor 210 is smooth-walled, while in FIG. 7, the tubular center conductor 210 is corrugated. In the first position of clearance, with the contact sleeve 120 being held on the contact pin 110 with relatively little force on the fingers 124 as compared to the force on the fingers 124 in the second position of intereference, the contact assembly 100 can slide into and out of the tubular center conductor 210 of the coaxial cable 200 with a relatively low moving force. The relatively low moving force will occur if/when the fingers 124 are pressed, even lightly, against the tubular center conductor 210 during assembly. It should be noted, that this relatively low moving force includes the possibility of a very low or no moving force being required to insert the contact assembly 100 if/when the fingers 124 of the contact sleeve 120 do not touch the tubular center conductor 210. For example, with this relatively low moving force, the contact assembly 100 can be slid into the hollow internal portion of the tubular center conductor 210 with less force than would be required if/when the contact assembly 100 is in the second position of interference. In the first position of clearance, when the contact assembly is inserted into the tubular center conductor 210, the contact flange 122 can face approximately perpendicular to the tubular center conductor 210 and can make contact with an end face 212 of the tubular center conductor 210 that is approximately perpendicular to the axis of the tubular center conductor 210, or the contact flange 122 can be spaced a distance from the end face 212 of the tubular center conductor 210 that is approximately perpendicular to the axis of the tubular center conductor 210.

Figure 8:
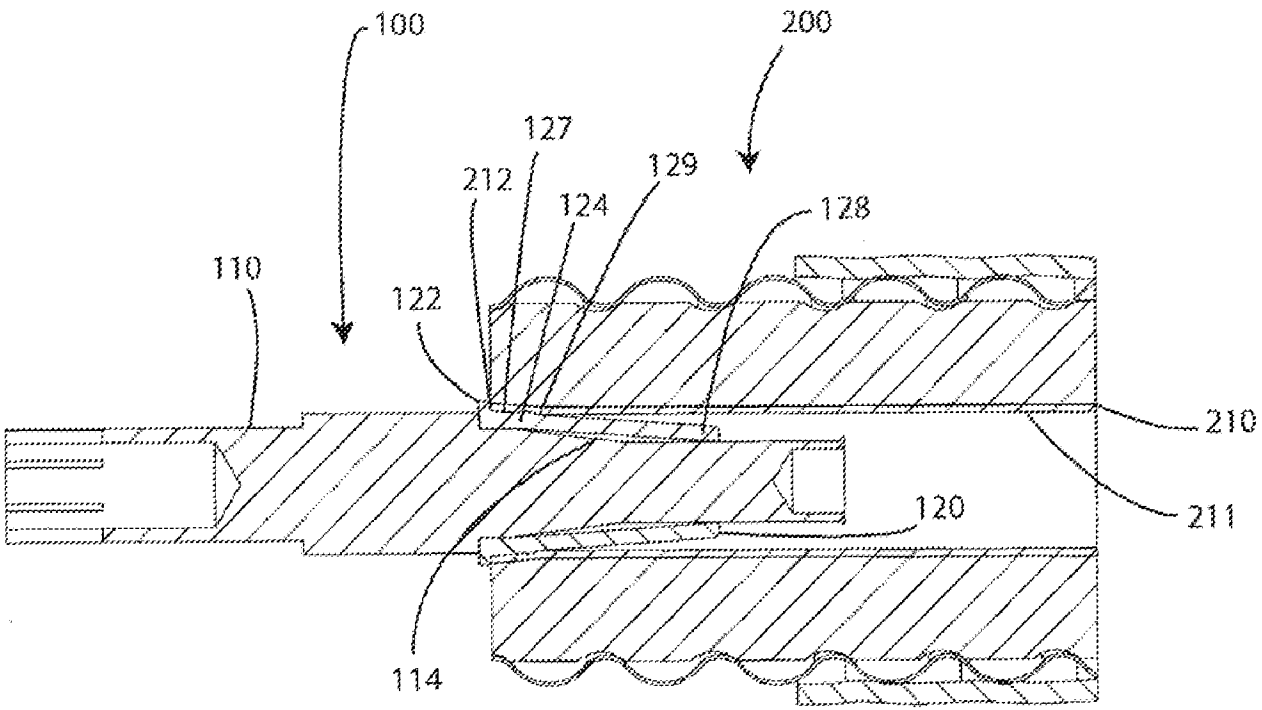
FIG. 8 shows a cross section of a contact assembly in a second position of interference inserted into a smooth-walled tubular center conductor, according to an embodiment of the invention having a sleeve retained by a retaining flange.
Figure 9:
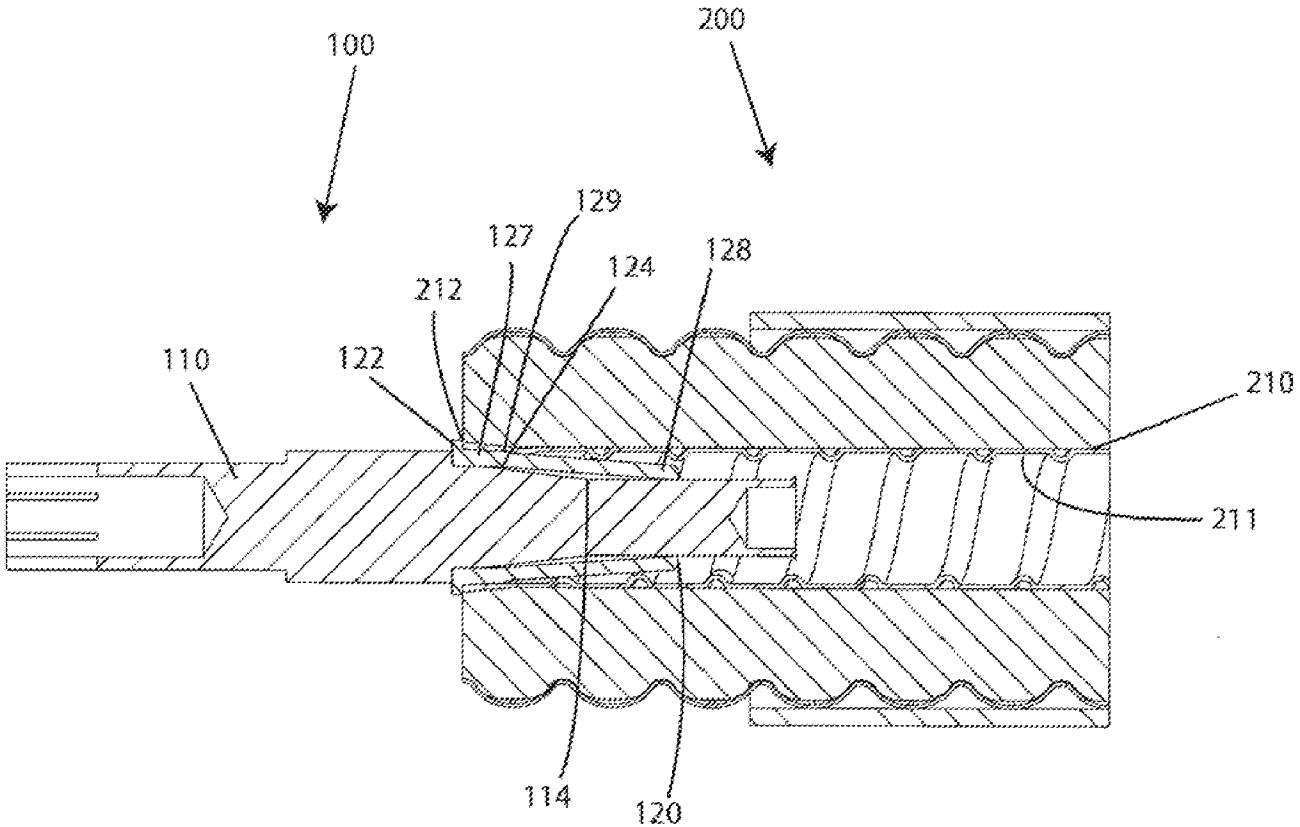
FIG. 9 shows a cross section of a contact assembly in a second position of interference inserted into a corrugated tubular center conductor, according to an embodiment of the invention having a sleeve retained by a retaining flange.

FIG. 8 and FIG. 9 each show a contact assembly 100 in a second position of interference inserted into a tubular center conductor 210, according to an embodiment of the invention. In FIG. 8, the tubular center conductor 210 is smooth-walled, while in FIG. 9, the tubular center conductor 210 is corrugated. In the second position of interference, the contact sleeve is pushed onto the ramped portion 114 of the contact pin 110. The ramped portion 114 engages the fingers 124 and pushes the fingers 124 radially outward to make contact with the inner surface 211 of the tubular center conductor 210. The contact pressure between the fingers 124 and the tubular center conductor 210 that is provided by the ramped portion 114 of the contact pin 110 increases the moving force required to displace the contact assembly 100 within the tubular center conductor 210, the increased moving force being greater than the relatively low moving force described above in relation to the first position of clearance. This increased moving force helps secure the contact assembly in the second position of interference. Furthermore, when the fingers 124 are pressed radially outward, the non-flanged end 128 can be moved radially inward, thereby pressing into the contact pin 110, which can further prevent the contact assembly 100, once assembly into the second position of interference, from being disassembled or loosened unintentionally.

The expanding ability of the fingers 124 accommodates use of the contact assembly 100 with coaxial cables categorized as the same size and type but having a tubular center conductor 210 ranging in actual dimensions. The tubular center conductors 210 of coaxial cables 200 categorized as the same size and type can vary in both actual physical dimensions and regularity. The tolerance ranges produce size variations, different manufacturers and different manufacturing processes produce size variations, and physical manipulation can cause size and regularity variations. The tubular center conductor 210 can be bent out of shape a regular cylindrical shape, for example. The expanding nature of the fingers 124 can accommodate these size variations and can make good electrical contact in each case. Because the fingers 124 can flex and expand radially along the span of the fingers 124, the fingers 124 can conform to irregularities in the tubular center conductor 210 to make good contact between the fingers 124 and the inside surface of the tubular center conductor 210. Furthermore, the contact sleeve 120 need not be supported and can be unsupported by the contact pin 110 toward and/or at the non-flanged end 128 of the contact sleeve 120, which enables the fingers 124 to have more radial movement and radial adjustability.

The fingers 124 can be variously shaped and sized to control, to increase, or to maximize the area of contact or the efficiency of the contact between the fingers 124 and the tubular center conductor 210. The fingers 124 can define slots 126 that extend parallel to each other, as illustrated in FIG. 1-4E. The slots 126 can be wide or thin, and the slots 126 can be relatively few (e.g. two), a moderate amount (e.g. four), or relatively many (e.g. 10 or more). The fingers 124 can be rectangular as illustrated in FIGS. 1, 2, and 3, or the fingers 124 can extend angled with respect to each other, or extend curved to create variously shaped fingers 124 and achieve varying deflective characteristics and electrical characteristics. For example, if few and/or wide-spread fingers 124 stretch or bend the tubular center conductor 210 to a non-cylindrical shape, a detrimental effect on the electrical qualities of the contact assembly 100, such as impedance matching, might occur. One solution to help avoid this problem might be to use more fingers spread more narrowly (e.g. narrower slots 126) to equalize pressure on the tubular center conductor 210. The shapes and numbers of fingers 124 can be varied as desired to achieve the desired result.

In this second position of interference, the ramped portion 114 also presses the flanged end 127 of each finger 124 radially outward farther than the non-flanged end 128 of each finger 124. This increasing deflection of the fingers 124 moving from the non-flanged end 128 of the fingers 124 toward the flanged end 127 of the fingers 124 creates relatively greater pressure of the fingers 124 against the inner surface 211 of the tubular center conductor 210 moving toward an end face 212 of the tubular center conductor 210. The greatest pressure on the inner surface 211 of the tubular center conductor, therefore, can be at the most longitudinally extreme point of the inner surface 211 of the tubular center conductor 210 toward the end face 212. Having increasing pressure on the inner surface 211 of the tubular center conductor 210 moving toward the end face 212 of the tubular center conductor 210 improves the likelihood or assures that the point of contact between the contact sleeve 120 and the inner surface 211 of the tubular center conductor 210 is close to the end face 212, or at the most longitudinally extreme point of the inner surface 211 of the tubular center conductor 210 toward the end face 212.

Making contact close to, or at the closest point to the end face 212 on the inner surface 211 of the tubular center conductor 210, or on the end face 212, can increase the electrical performance of an electrical connector to which the contact assembly 100 and hard line coaxial cable 200 are attached (e.g. reduce return loss). Electrical and/or electromagnetic signals that travel to the end and/or end face 212 of the tubular center conductor and then bounce or deflect back are reduced or prevented. Interference is therefore reduced or prevented. Similarly, contact between the contact sleeve 120 and the tubular center conductor 210 can be toward or at the flanged end 127 of the contact sleeve, and contact between the contact sleeve 120 and contact pin 110 can be avoided toward or at the non-flanged end of the contact sleeve 120, and/or along the span of the contact sleeve 120 between flanged end 127 and the non-flanged end 128. An insulating ring or insulating sleeve can be positioned between the non-flanged end 127 of the contact sleeve 120 and the contact pin 110, to further prevent electrically conductive contact at the non-flanged end 127.

The barbs 129, which can be located toward the flanged end 127 of the contact sleeve 120, also can promote and/or ensure contact between the contact sleeve 120 and the tubular center conductor 210. The barbs 129 can have a larger diameter than any other portion of the retaining sleeve 120 inside the tubular center conductor 210 in the second position of interference. If the barbs 129 do not have the largest radius from the center of the contact sleeve 120 of any portion of the retaining sleeve 120 inside the tubular center conductor 210 in the second position, then the barbs 129 can have the largest radius in locality of the barbs 129 (e.g. immediately in either axial direction from the barbs 129). In the former case, the barbs 129 are pressed radially outward the farthest by the ramped portion 114, and with the greatest force into the tubular center conductor 210. The barbs 129 and the radially outward facing surface of the fingers 124 at the flanged end 127 of the contact sleeve 120 can make good contact; or the barbs 129 can be located very close to the flanged end 127 or on the flanged end 127 of the contact sleeve 120, and the barbs 129 can make contact with the tubular center conductor 210 closest to the contact flange 122. In the latter case, the barbs 129 are pressed radially outward a farther distance than the immediately adjacent areas, increasing the likelihood of at least good contact made circumferentially where the barbs 129 are pressed into the tubular center conductor 210. In this case, the radially outward facing surface of the fingers 124 at the flanged end 127 of the contact sleeve 120 can make good contact with the tubular center conductor 210 nearest the end contact flange 122, and the barbs 129 can make contact with the tubular center conductor 210 in addition, or as backup to ensure contact is made. The barbs 129 can also help make a good contact with the tubular center conductor 210 in case the end of the tubular center conductor 210 deforms, which can weaken the contact made at the flanged end 127 of the tubular center conductor 210. The barbs 129 can also act to help secure the contact assembly 100 from accidentally dislodging once the contact assembly 100 is assembled with the coaxial cable 200, as the barbs 129 can further increase the moving force required to displace the contact assembly 100 within the tubular center conductor 210.

In the second position of interference, when the contact assembly is inserted into the tubular center conductor 210, the contact flange 122 can face approximately perpendicular to the end face 212 of the tubular center conductor 210. The contact flange 122 can make contact with the end face 212 of the tubular center conductor 210 or the contact flange 122 can be spaced a distance from the end face 212 of the tubular center conductor 210. When the contact flange 122 makes contact with the end face 212 of the tubular center conductor 210, extra length of the tubular center conductor beyond contact where conduction of electrical or electromagnetic signals to the contact assembly 100 can occur is reduced, minimized, or eliminated, so that interference and/or degradation of the signals resulting from signals extending beyond the contact where the conduction occurs and then bouncing or doubling back is reduced, minimized, or eliminated.

Furthermore, when used with a corrugated tubular center conductor 210, having the contact flange 122 make contact with the tubular center conductor 210 can improve electrical performance by addressing, reducing, or eliminating the "hanging" reverse path for RF propagation. Gap in contact at the corrugated portions of the tubular center conductor 210 around the circumference of the inner surface 211 of the tubular center conductor 210 are avoided. The connection between the contact flange 122 and the end face 212 of the tubular center conductor 210 is at least approximately axially equidistant around the circumference of the end face 212, which can reduce or eliminate the undesirable RF effect on the performance of the contact assembly 100 and the connector in which the contact assembly 100 is assembled.

Figure 10:
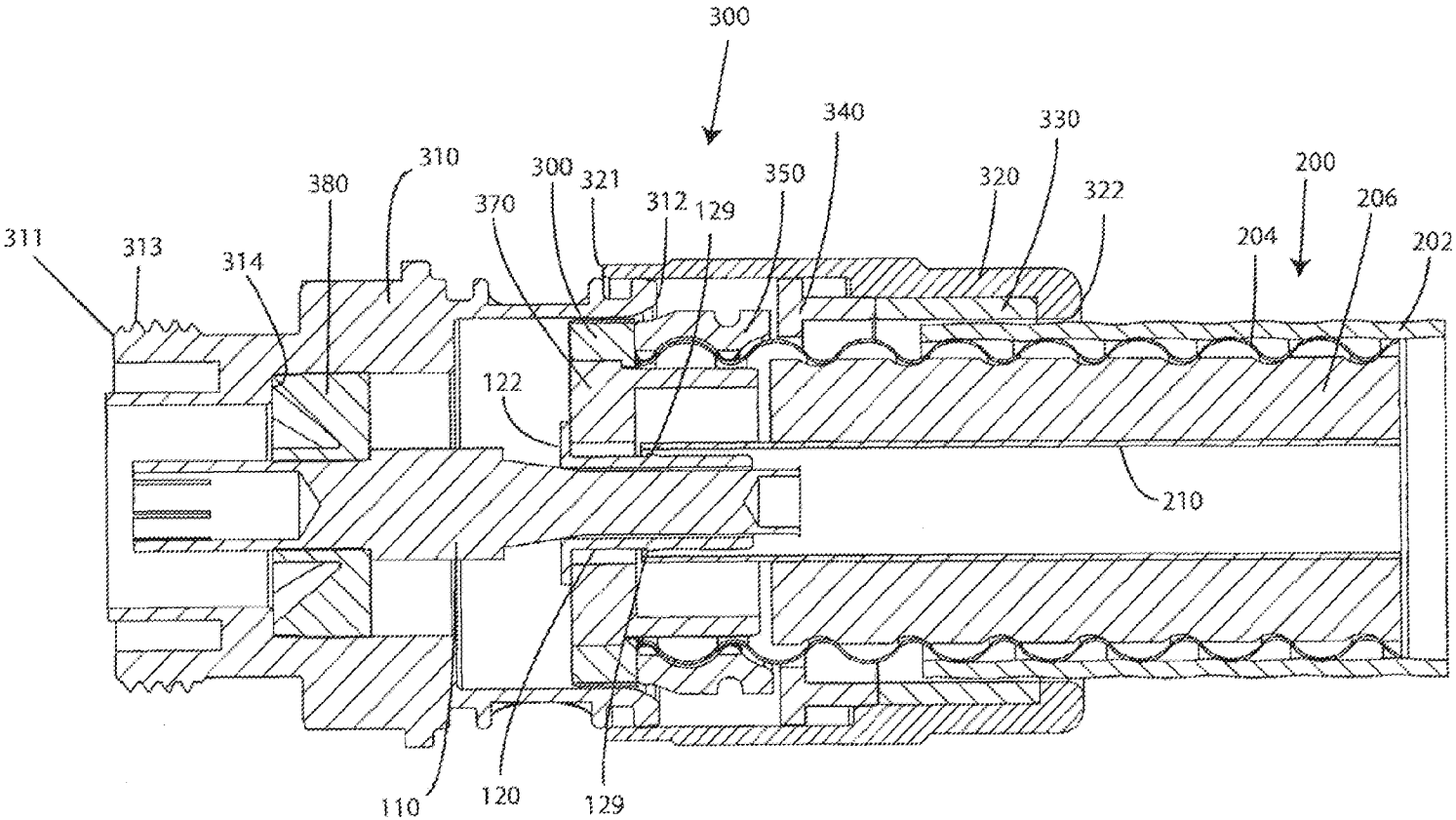
FIG. 10 shows a cross section of a contact assembly assembled with a connector, the connector positioned to be connected and secured to a coaxial cable, the contact assembly being in a first position of clearance, according to one embodiment of the invention.
Figure 11:
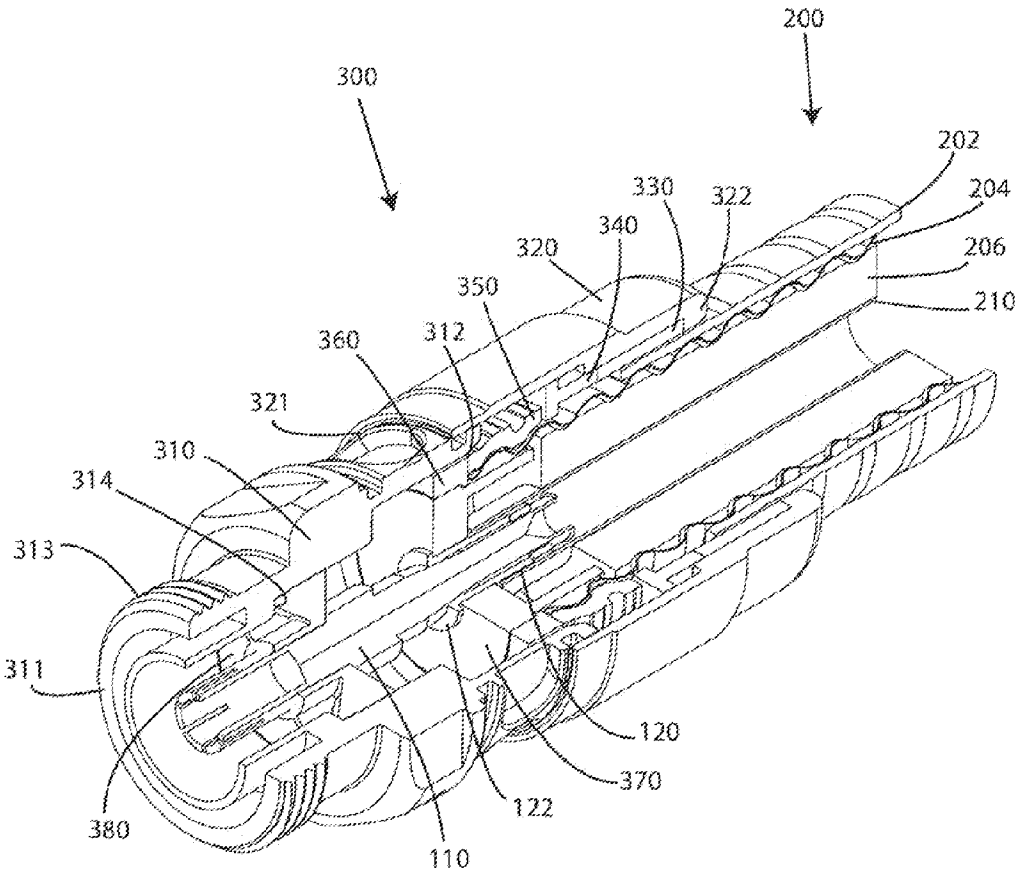
FIG. 11 shows a sectioned perspective view of the contact assembly, connector, and coaxial cable of FIG. 9.

FIG. 10 and FIG. 11 illustrate a contact assembly assembled with a hard line connector 300, the connector 300 positioned to be connected to a coaxial cable 200, the contact assembly being in a first position of clearance, according to one embodiment of the invention. The connector 300 includes a body 310 and a cap 320. The body 310 is positioned forward of the cap 320, and the cap 320 is positioned rearward of the body 310, with a forward end 321 of the cap 320 concentrically disposed over a rearward end 312 of the body 310. A forward end 311 of the body 310 can connect to a mating connector, such as by screwing with threads 313. The rearward end 322 of the cap 320 can allow the coaxial cable 200 to enter into the cap 320 so that the cap 320 is concentrically disposed over the coaxial cable 200.

Concentrically disposed inside the cap 320, from the rearward end 322 to the forward end 321, are a seal 330, a clamp ring 340, a clamp 350, and a mandrel ring 360. Engaged with the mandrel ring 360, and concentrically disposed within the mandrel ring 360 and the clamp 350, is a mandrel 370. The mandrel 370, the mandrel ring 360, and the clamp 350 can also be partly or fully concentrically disposed within the body 310, instead of, or in addition to being concentrically disposed partly or fully within the cap 320. An insulator 380 is concentrically disposed within the body 310. The contact assembly 100 is positioned between and extended through the insulator 380 and the mandrel 360. The first ridge 112 abuts the insulator 380, the insulator 380 abuts a shoulder 314 extending radially inward from the inner surface of the body 310, and the first insulator 380 and the contact assembly 100 are prevented from moving forward toward the forward end 311 of the body 310.

The coaxial cable 200 can be inserted into the connector 300 through the rearward end 322 of the cap 320. A portion of an outer insulating layer 202 can be removed to expose the outer surface of an outer conductor 204, and a portion of a dielectric layer 206 between the tubular center conductor 210 and the outer conductor 204 can be removed. The coaxial cable 200 can extend through the seal 330, the clamp ring 340, and the clamp 350. The inside surface of the clamp 350 can be corrugated, or can have a shape otherwise congruent with the outer conductor 204, so that the clamp 350 can mate and/or conform with the outer conductor 204 to strengthen the clamping action of the clamp 350 on the coaxial cable 200. The portion of the dielectric layer 206 that was removed allows space for the outer conductor 204 to extend concentrically over the mandrel 370. The tubular center conductor 210 is extended so that the tubular center conductor 210 is concentrically disposed over the contact assembly 100, and in particular, the contact sleeve 120 and/or the barbs 129.

The contact assembly 100 can be moved from the first position of clearance to the second position of interference by securing the coaxial cable 200 inside the connector 300. To secure the coaxial cable 200 inside the connector 300, the cap 320 is moved axially forward toward the forward end 311 of the body 310 and/or the body 310 is moved axially rearward toward the rearward end 322 of the cap 320. When the cap 320 is moved forward relative to the body 310, the cap 320 drives the clamp ring 340 forward relative to the body 310. The clamp ring 340, in turn, compresses the clamp 350, and drives the clamp 350 forward into, and/or farther into the body 310. The clamp 350 has an outer diameter greater than the inner diameter of the rearward end 312 of the body 310, which causes an interference fit between the clamp 350 and the body 310. The interference fit provides a retention force between the clamp 350 and the body 310. The retention force may also be created or enhanced by other known methods, such as an adhesive, interlocking mechanical components, etc.

The clamp 350 is also compressed inward, providing a clamping force on the outer conductor 204 of the coaxial cable 200. When the clamp 350 is driven forward relative to the body 310, the clamp 350 drags the coaxial cable 200 forward relative to the body 310 as well.

Additionally, the clamp 350 drives the mandrel ring 360 forward. The mandrel ring 360 interlocks mechanically with the mandrel 350, so that the mandrel ring 360 imposes a forward force on the mandrel 350, driving and/or pulling the mandrel 350 forward. The mandrel 350, in turn, abuts on the rearward side of the contact flange 122, and through this contact with the contact flange 122, the mandrel 350 drives the contact sleeve 120 forward in relation to the body 310 and the contact pin 110. So the tubular center conductor 210 can be driven forward in relation to the body 310 and contact pin 110 the same distance, at the same rate, and at the same time as the contact sleeve, in order to secure the coaxial cable 200 in the connector 300, and move the contact assembly 100 from a first position of clearance into a second position of interference to establish electrical contact between the connector 300 and the tubular center conductor 210.

Figure 12:
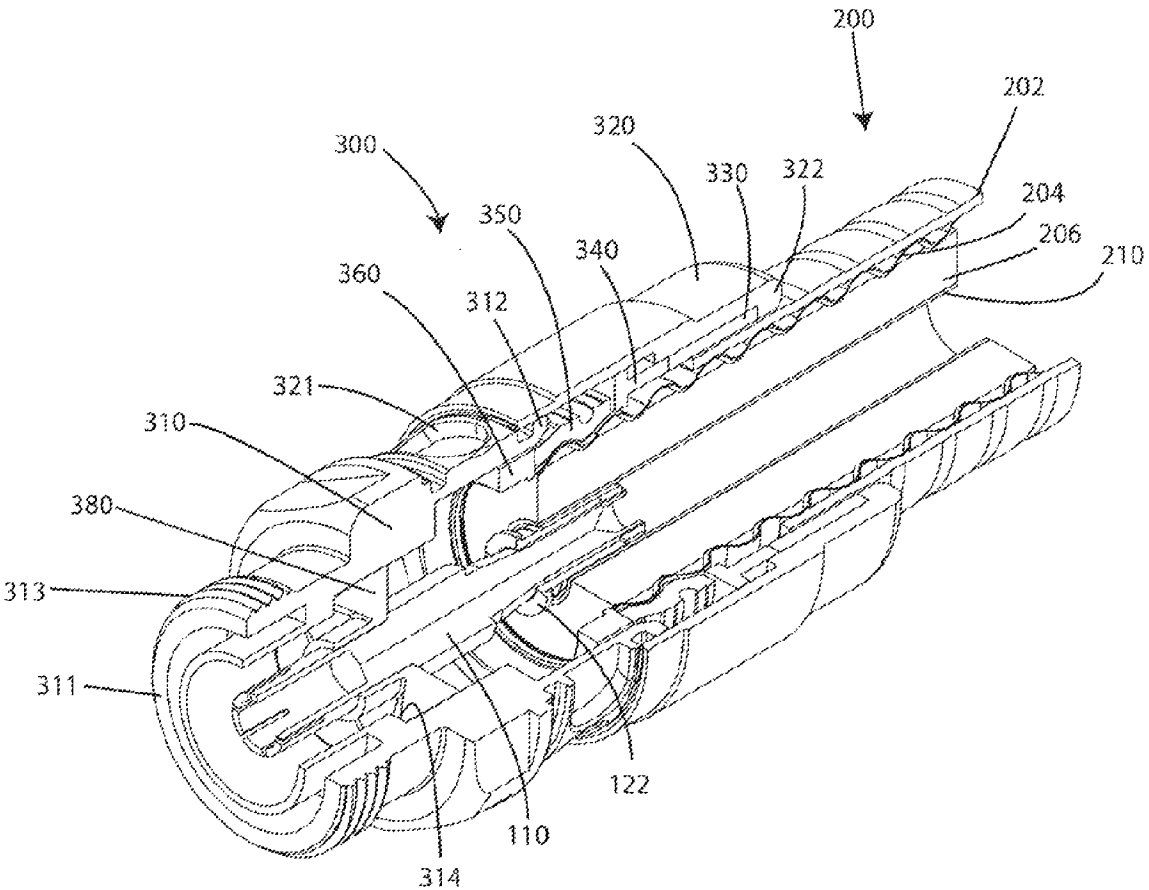
FIG. 12 shows a sectioned perspective view of a contact assembly assembled with a connector, the connector positioned to be connected and secured to a coaxial cable, the contact assembly being in a first position of clearance, according to an alternate embodiment of the invention.

FIG. 12 shows a sectioned perspective view of a contact assembly 100 assembled with a connector 300, the connector 300 positioned to be connected and secured to a coaxial cable 200, the contact assembly 100 being in a first position of clearance, according to an embodiment using no mandrel 350 (i.e. contact assembly directly engages an end face portion of the dielectric layer 206, as shown in FIG. 11). The dielectric layer 206 is left intact. In other words, no portion of the dielectric layer 206 is removed, which saves time and expense associated with the operation of removing the portion of the dielectric layer 206. When the coaxial cable 200 is inserted into the connector 300, the dielectric layer 206 can extend to be flush with the end f the tubular center conductor 210 and the outer conductor 204. Having the ends of the dielectric layer 206, the tubular center conductor 210, and the outer conductor 204 be flush makes preparation of the coaxial cable 200 before insertion simple, as the coaxial cable 200 can be cut straight through to achieve the flush arrangement. Moreover, two connectors, such as connector 100 may be utilized to create a jumper that may be packaged and sold to a consumer. A jumper may be a coaxial cable 10 having a connector, such as connector 100, operably affixed at one end of the cable 10 where the cable 10 has been prepared, and another connector, such as connector 100, operably affixed at the other prepared end of the cable 10. Operably affixed to a prepared end of a cable 10 with respect to a jumper includes both an uncompressed/open position and a compressed/closed position of the connector while affixed to the cable. For example, embodiments of a jumper may include a first connector including components/features described in association with connector 100, and a second connector that may also include the components/features as described in association with connector 100, wherein the first connector is operably affixed to a first end of a coaxial cable 10, and the second connector is operably affixed to a second end of the coaxial cable 10. Embodiments of a jumper may include other components, such as one or more signal boosters, molded repeaters, and the like.

When securing the coaxial cable 200 inside the connector 300, the cap 320 is moved axially forward toward the forward end 311 of the body 310 and/or the body 310 is moved axially rearward toward the rearward end 322 of the cap 320. When the cap 320 is moved forward relative to the body 310, the cap 320 drives the clamp ring 340 forward relative to the body 310. The clamp ring 340, in turn, compresses the clamp 350, and drives the clamp 350 forward into, and/or farther into the body 310. The clamp 350 has an outer diameter greater than the inner diameter of the rearward end 312 of the body 310, which causes an interference fit between the clamp 350 and the body 310. The interference fit provides a retention force between the clamp 350 and the body 310. The retention force may also be created or enhanced by other known methods, such as an adhesive, interlocking mechanical components, etc.

The clamp 350 is also compressed inward, providing a clamping force on the outer conductor 204 of the coaxial cable 200. When the clamp 350 is driven forward relative to the body 310, the clamp 350 drags, pulls, or moves the coaxial cable 200 forward relative to the body 310 as well. When the coaxial cable 200 moves forward, the dielectric layer 206 abuts the contact flange 122 and drives the contact sleeve 120 forward onto the ramped portion 114 of the contact pin 110.

The connectors and connector components described are exemplary to illustrate how the contact assembly 100 can be moved from the first position of clearance to the second position of interference during attachment and securement of the connector 300 to the coaxial cable 200. Other connectors can also be used in conjunction with the contact assembly 100. For example, the mechanism by which the connector 300 is secured to the coaxial cable 200 can vary, such as by screwing together the body 310 and the cap 320, or by compressing a compression sleeve extending from the rearward end of a single body that houses all the internal components. As another example, a male or female version of the contact assembly 100 is conceived, and the corresponding differences in connectors 300 are also conceived.

Figure 13:
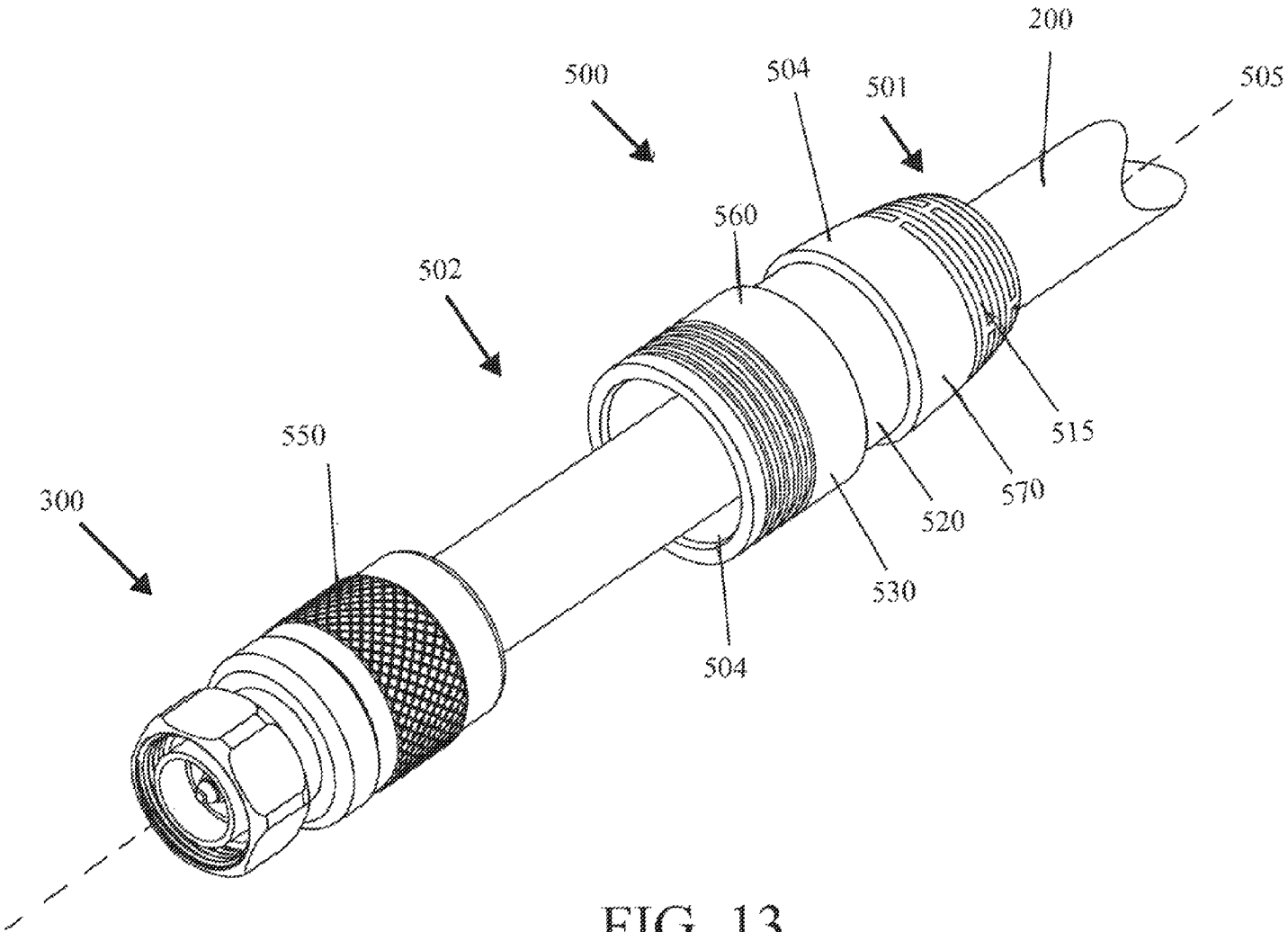
FIG. 13 depicts a perspective view of an embodiment of a coaxial cable connector having a cover in a first position.
Figure 14:
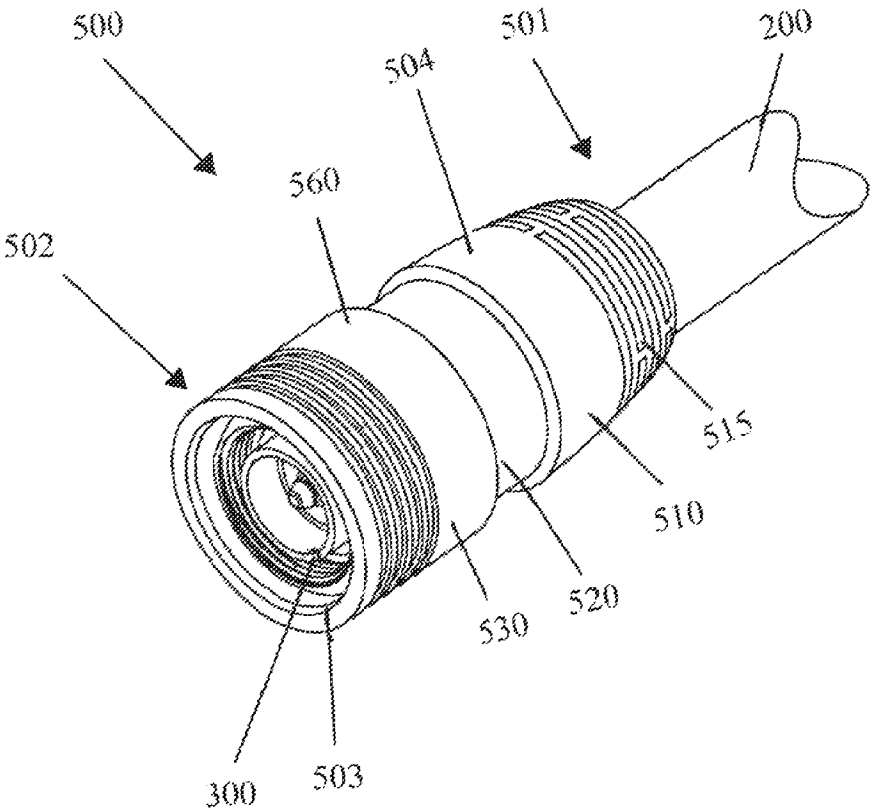
FIG. 14 depicts a perspective view of an embodiment of the coaxial cable connector having a cover in a second, sealing position.

With continued reference to the drawings, FIGS. 13 and 14 depict an embodiment of connector 300 having a cover 500. FIG. 13 depicts an embodiment of connector 300 having a cover 500 in a first position. FIG. 14 depicts an embodiment of connector 300 having a cover 500 in a second, sealing position. Cover 500 may be a seal, a sealing member, a sealing boot, a sealing boot assembly, and the like, that may be quickly installed and/or removed over a connector, such as connector 300, and may terminate at a bulkhead of a port or at a sliced connection with another coaxial cable connector of various sizes/shapes. Cover 500 can protect the cable connectors or other components from the environment, such as moisture and other environmental elements, and can maintain its sealing properties regardless of temperature fluctuations. Embodiments of cover 500 may be a cover for a connector 300 adapted to terminate a cable 10, wherein the cover 500 comprises an elongated body 560 comprising a cable end 501 and a coupler end 502, an interior surface 503 and an exterior surface 504, wherein the elongated body 560 extends along a longitudinal axis 505. The interior surface 503 can include a first region 510 adapted to cover at least a portion of the cable 10 and can extend from the cable end 501 to a first shoulder, wherein the first region is of a minimum, first cross-sectional diameter. The interior surface 503 may further include a second region 520 which is adapted to cover at least the connector body portion 550 and which may extend from the first shoulder to a second shoulder. The second region 520 may have a minimum, second cross-sectional diameter that is greater than the minimum, first cross-sectional diameter. The interior surface 503 may further include a third region 530 which is adapted to cover at least a portion of the connector 200 and which extends from the second shoulder to the coupler end 502. The third region 530 may have a minimum, third cross-sectional diameter that is greater than the minimum, second cross-sectional diameter. Further embodiments of the cover 500 may include a plurality of circumferential grooves 515 to provide strain relief as the cover moves from the first position to the second position. The circumferential grooves 515 can extend less than completely around the circumference of the first region 510 of cover 500. Furthermore, embodiments of the cover 500 may comprise an elastomeric material that maintains its sealing abilities during temperature fluctuations. In one embodiment, the cover 500 is made of silicone rubber.

Referring to FIGS. 1-15, a method of ensuring electrical contact with a tubular center conductor, comprising providing a contact assembly, wherein the contact assembly includes: contact pin having a first end and a second end, the contact pin including a ramped portion, and a contact sleeve retainably attached to the first end of the contact pin, the contact sleeve having a flanged end and a non-flanged end, wherein the contact sleeve includes a plurality of fingers; driving the contact sleeve towards the second end of the contact pin to position the contact sleeve into engagement with the ramped portion of the contact pin to radially expand the fingers of the contact sleeve into contact with an inner surface of the tubular center conductor.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims

What is claimed is:

1. A contact assembly comprising:

a contact pin having a first end and a second end, the contact pin including a ramped portion; and a contact sleeve retainably attached to the first end of the contact pin, the contact sleeve having a flanged end and a non-flanged end, wherein the contact sleeve includes one or more fingers;

wherein, when in a first position, clearance exists between the contact sleeve and the contact pin;

wherein, when in a second position, the one or more fingers of the contact sleeve engage an inner surface of a tubular center conductor to increase a moving force required to displace the contact assembly within the tubular center conductor.

2. The contact assembly of claim 1, wherein, when in the first position, the moving force is low such that the contact assembly can slide into and out of the tubular center conductor.

3. The contact assembly of claim 1, wherein the contact sleeve is retained on the contact pin by a sleeve retainer.

4. The contact assembly of claim 1, wherein the contact sleeve is retained on the contact pin through compliant contact between the sleeve and the pin.

5. The contact assembly of claim 1, wherein, in the second position, a greater contact pressure between the one or more fingers of the sleeve and the inner surface of the tubular center conductor occurs proximate the flanged end of the sleeve.

6. The contact assembly of claim 1, wherein the ramped portion of the contact pin radially expands the one or more fingers of the contact into engagement within the inner surface of the tubular center conductor in the second position.

7. The contact assembly of claim 1, wherein the one or more fingers are separated by a plurality of axial openings originating from the flanged end of the contact sleeve.

8. The contact assembly of claim 1, wherein the one or more fingers are separated by a plurality of axial openings originating from the flanged end of the contact sleeve and originating from the non-flanged end of the contact sleeve.

9. The contact assembly of claim 1, wherein the one or more fingers are separated by a single axial opening extending lengthwise the contact sleeve.

10. The contact assembly of claim 1, wherein the contact sleeve includes at least one internal ramped portion.

11. The contact assembly of claim 1, wherein the contact sleeve further includes one or more barbs annularly extending proximate the flanged end of the contact sleeve to further prevent disengagement of the contact pin from within the tubular center conductor.

12. The contact assembly of claim 1, wherein the non-flanged end of the sleeve engages the inner surface of the tubular center conductor to further prevent disengagement of the contact pin from within the tubular center conductor.

13. The contact assembly of claim 1, wherein the tubular center conductor is smooth-walled.

14. The contact assembly of claim 1, wherein the tubular center conductor is corrugated.

15. The contact assembly of claim 1, wherein the contact assembly is male.

16. The contact assembly of claim 1, wherein the contact assembly is female.

17. A connector positioned to be connected to a coaxial cable, the coaxial cable including a tubular center conductor, an outer insulating layer, an outer conductor, and a dielectric layer, the connector comprising:

a body having a forward end and a rearward end;

a cap concentrically disposed over the rearward end of the body; and a contact assembly, wherein the contact assembly includes:

a contact pin having a first end and a second end, the contact pin including a ramped portion; and a contact sleeve retainably attached to the first end of the contact pin, the contact sleeve having a flanged end and a non-flanged end, wherein the contact sleeve includes one or more fingers;

wherein the compression cap axially compresses the connector into a position of interference from a position of clearance, the interference being between the one or more fingers and an inner surface of the tubular center conductor.

18. The connector of claim 17, wherein the contact assembly is positioned between and extended through a mandrel.

19. The connector of claim 17, wherein the contact assembly directly engages an end face portion of the dielectric layer.

20. The connector of claim 17, wherein the tubular center conductor is corrugated.

21. The connector of claim 17, wherein the tubular center conductor is smooth-walled.

22. The connector of claim 17, further comprising:

a clamp, a mandrel ring, an insulator, and a seal disposed within the body.

23. The connector of claim 17, wherein the contact assembly is male.

24. The connector of claim 17, wherein the contact assembly is female.

25. A method of ensuring electrical contact with a tubular center conductor, comprising:

providing a contact assembly, wherein the contact assembly includes:

contact pin having a first end and a second end, the contact pin including a ramped portion, and a contact sleeve retainably attached to the first end of the contact pin, the contact sleeve having a flanged end and a non-flanged end, wherein the contact sleeve includes one or more fingers; and driving the contact sleeve towards the second end of the contact pin to position the contact sleeve into engagement with the ramped portion of the contact pin to radially expand the one or more fingers of the contact sleeve into contact with an inner surface of the tubular center conductor.

26. The method of claim 25, further comprising:

retaining the contact sleeve onto the first end of the contact pin with a sleeve retainer.

27. The method of claim 25, wherein a greater contact pressure between the one or more fingers of the sleeve and the inner surface of the tubular center conductor occurs proximate the flanged end of the sleeve after driving the contact sleeve.

28. The method of claim 25, further comprising:

positioning one or more annular barbs proximate the flanged end of the contact sleeve to further prevent disengagement of the contact pin from within the tubular center conductor.

29. The method of claim 25, wherein the non-flanged end of the sleeve engages the inner surface of the tubular center conductor to further prevent disengagement of the contact pin from within the tubular center conductor.

30. The method of claim 25, wherein the tubular center conductor is smooth-walled.

31. The method of claim 25, wherein the tubular center conductor is corrugated.

32. The method of claim 25, wherein the contact assembly is male.

33. The method of claim 25, wherein the contact assembly is female.

34. A coaxial cable connector comprising:

a body having a forward end and a rearward end;

a cap concentrically disposed over the rearward end of the body; and a contact assembly, wherein the contact assembly includes:

a contact pin having a ramped portion, and a contact sleeve retainably attached to the first end of the contact pin; and a cover disposed over at least a portion of the connector to seal the connector against environmental elements.

35. The coaxial cable connector of claim 34, wherein the cover is an elastomeric material configured to be quickly removed and installed.

36. The connector of claim 34, further comprising:

a clamp, a mandrel ring, an insulator, and a seal disposed within the body.

* * * * *